US008117788B1

(12) United States Patent
Mueller et al.

(10) Patent No.: US 8,117,788 B1
(45) Date of Patent: Feb. 21, 2012

(54) ENERGY DISSIPATING ASSEMBLY FOR FRAME WALLS

(76) Inventors: Lee W. Mueller, Las Vegas, NV (US); Reynaud L. Serrette, San Jose, CA (US)

( * ) Notice: Subject to any disclaimer, the term of this patent is extended or adjusted under 35 U.S.C. 154(b) by 0 days.

(21) Appl. No.: 12/576,191

(22) Filed: Oct. 8, 2009

Related U.S. Application Data

(63) Continuation of application No. 10/891,421, filed on Jul. 13, 2004, now abandoned, which is a continuation-in-part of application No. 09/932,181, filed on Aug. 17, 2001, now Pat. No. 6,761,001.

(60) Provisional application No. 60/226,354, filed on Aug. 18, 2000.

(51) Int. Cl.

| | |
|---|---|
| ***E04H 9/00*** | (2006.01) |
| ***E04H 9/02*** | (2006.01) |
| ***E04B 1/98*** | (2006.01) |
| ***E04B 1/343*** | (2006.01) |

(52) U.S. Cl. ..... 52/167.3; 52/1; 52/167.4; 52/573.1

(58) Field of Classification Search ..... 52/1, 167.1, 52/167.3–167.8, 576.1, 293, 300
See application file for complete search history.

(56) References Cited

U.S. PATENT DOCUMENTS

| | | | | |
|---|---|---|---|---|
| 4,675,238 | A * | 6/1987 | Karoubas | 428/599 |
| 4,905,444 | A * | 3/1990 | Semaan et al. | 52/710 |
| 4,910,929 | A * | 3/1990 | Scholl | 52/167.3 |
| 5,054,251 | A * | 10/1991 | Kemeny | 52/167.8 |
| 5,533,307 | A * | 7/1996 | Tsai et al. | 52/167.3 |
| 5,630,298 | A * | 5/1997 | Tsai et al. | 52/167.3 |
| 5,706,626 | A * | 1/1998 | Mueller | 52/800.12 |
| 5,913,788 | A * | 6/1999 | Herren | 52/241 |
| 6,058,668 | A * | 5/2000 | Herren | 52/241 |
| 6,148,583 | A * | 11/2000 | Hardy | 52/693 |
| 6,212,849 | B1 * | 4/2001 | Pellock | 52/693 |
| 6,233,884 | B1 * | 5/2001 | Tipping et al. | 52/167.1 |
| 6,247,275 | B1 * | 6/2001 | Taylor | 52/167.3 |
| 6,672,573 | B2 * | 1/2004 | Berton | 267/136 |

FOREIGN PATENT DOCUMENTS

| | | | |
|---|---|---|---|
| JP | 02144435 | A * | 6/1990 |
| JP | 02300475 | A * | 12/1990 |
| JP | 02300476 | A * | 12/1990 |

* cited by examiner

*Primary Examiner* — Eileen D Lillis
*Assistant Examiner* — Elizabeth A Plummer
(74) *Attorney, Agent, or Firm* — Knobbe, Martens, Olson & Bear, LLP

(57) ABSTRACT

Lateral motion devices are used in conjunction with relatively rigid shear assemblies to further dissipate shear forces on frame construction buildings. In one embodiment, the lateral motion device is interposed between the shear assembly and the upper portion of the wall to permit relative motion therebetween and to absorb and dissipate a portion of the energy associated with shear force through spring-like behavior and deformation. In one embodiment, the energy dissipation is achieved by a plurality of corrugation structures, where the top of the corrugation is attached to the upper portion of the wall and the bottom of the corrugation is attached to an interconnecting assembly that is securely attached to the foundation. Placing the energy dissipating device near the upper portion of the wall mounted on a comparatively rigid frame provides a relatively short moment arm with respect to the lateral forces imposed by the wall on the energy dissipating device to allow better control of the response to the shear force.

18 Claims, 14 Drawing Sheets

ENERGY DISSIPATING ASSEMBLY FOR FRAME WALLS

RELATED APPLICATIONS

This application is a continuation of U.S. application Ser. No. 10/891,421, filed Jul. 13, 2004, now abandoned entitled "ENERGY DISSIPATING ASSEMBLY FOR FRAME WALLS" which is a continuation-in-part of U.S. patent application Ser. No. 09/932,181, filed on Aug. 17, 2001, now U.S. Pat. No. 6,761,001 entitled "A-FRAME SHEAR ASSEMBLY FOR WALLS," which are hereby incorporated by reference in their entirety. This application also claims the benefit of U.S. Provisional Application No. 60/226,354, filed on Aug. 18, 2000, entitled "A-FRAME SHEAR ASSEMBLY FOR WALLS."

BACKGROUND

1. Field

The present teachings relates to the construction industry and, in particular, concerns systems and methods for providing improving lateral strengthening and performance of wall structures using a shear assembly with energy-dissipating attachment members.

2. Description of the Related Art

Low-rise, commercial, institutional and residential (single and multi-family) buildings comprise the majority of buildings in the United States. Within this group of buildings, by far the most prevalent type of structure is the light framed structure, specifically wood or cold-formed/light-gauge steel framing. In the typical light framed building structure, as in any other building structure, the basic structural design goals is to ensure the safe performance of the building under anticipated loading conditions. Safe performance may include, but is not limited to, one or more of the following performance objectives: operational/immediate occupancy performance, life safety performance and collapse prevention performance (FEMA-273 "*NEHRP Guidelines for the Seismic Rehabilitation of Buildings,*" 1997).

The loads to be considered in design vary in the degree by which they can be reasonably (in a probabilistic sense) defined. Fundamentally though, there are two types of load to consider in design: gravity and lateral loads. Gravity loads, as the name implies, act vertically and they have one characteristic that makes them more deterministic than lateral loads—they can be controlled to some extent. Lateral loads (for example those induced by earthquakes and hurricane/tornado winds) are unpredictable in both occurrence and magnitude. In design for lateral load, the conventional philosophy has been to provide a lateral load resisting structural system that is strong enough to resist the maximum expected design event. In earthquake resistant design, this philosophy is further augmented by the additional requirement for inelastic deformation capability (ductility) of the lateral load resisting system. Inherent in this ductility requirement is the understanding that under the maximum design event, a building will undergo some amount of damage associated with the design performance objectives stated above.

In conventional light framed building construction, gravity and lateral load resistance is achieved essentially by a stick frame (studs, joists, rafter and trusses) for the gravity loads and sheathing attached to the stick frame for lateral loads. Loads are typically generated at different levels within the building and must be carried to the foundation via the combined action of the stick frame and the attached sheathing. This combined action implies that some elements of the gravity and lateral load systems will be common. As a result, failure of any one of these common elements under one loading condition (say lateral) can compromise the integrity of the entire system under the other condition.

Sheathed stick-framed walls that are designed to resist lateral loads are commonly referred to in the literature as shear walls or vertical diaphragms. The details of how a shear wall resists lateral load are quite complex. Generally though, the basic mechanism of resistance is achieved by a transfer of load from the point where they are generated into the frame, from the frame into the sheathing, from the sheathing back into the frame and from the frame into the foundation. Because of this load path, each component in the load path needs to have capacity of transferring the full load for a shear wall to work as expected. In other words, the performance of the shear wall is controlled by its weakest link. In earthquake resistant design, performance is attained by having the capacity to transfer loads at the foundation be higher than the capacity of the sheathing to frame attachment.

The sheathing materials commonly used in light frame shear wall construction typically include plywood, oriented strand board, fiberboard, gypsum wallboard/sheathing board, siding and sheet steel. The sheathing is typically attached to the frame with nails, staples or screws. In some cases, as may be the case with light gauge steel framing, sheet steel may be attached to the frame by clinching, welding or an adhesive. Additionally, in cold-formed steel construction lateral resistance may also be accomplished with flat-strap x-bracing. These generic systems, which are typically included in building codes, are not the only means of providing lateral resistance. In fact, other prefabricated systems are available for use as braced wall components. The primary benefits of these systems are improved performance due to the quality control associated with fabrication of the component and ease of installation in the field.

The aforementioned prefabricated systems, though more advanced than shear and x-braced walls, provide a response similar to that of the conventional field-built shear wall. That is, to develop a certain level of lateral resistance under the design event, these systems must undergo significant inelastic deformation (damage) which in turn results in damage to the contents and other non-structural components of the building. Furthermore, conventional shear walls and other prefabricated panel systems used in light framed buildings, may have to be comparatively large or strong to withstand the magnitude of lateral loads and/or deformations that are generated in design events or as limited by building codes. For example, most building codes limit the inelastic story drift or lateral displacement to between 2 inches and 2.5 inches for an 8-foot wall height in all types of buildings. To meet this limitation, the braced wall (shear wall, x-bracing or prefabricated system) must generally be ductile (ability to deform), strong and stiff. As the stiffness and strength of bracing components increase, the demands placed on other components of the structure also increases, thereby requiring larger members. It can be appreciated that multi-story buildings will be more susceptible to larger lateral forces/deformations often necessitating even larger lateral bracing structures. Increased spatial requirements for the lateral bracing system exacerbates the problem of a limited amount of space in walls of smaller lengths.

Hence, there is a need for a lateral bracing system that is easy to install, is comparatively small in size so that it can be readily installed in walls having short lengths, has the ability to dissipate energy without significant damage to the structures (and its components), has the ability to reduce the magnitude of deformations and forces induced in the building, improves life-safety of occupants and protects building functionality. To this end, there is a need for a prefabricated internal shear assembly with a mechanical lateral motion energy dissipating device.

SUMMARY

The foregoing needs are addressed by one aspect of the present teachings relating to a system for reducing the effects of shear forces on a building structure. The system includes a wall comprising a plurality of vertical studs. The wall includes an upper portion and a lower portion and the upper portion of the wall is adjacent the upper portion of the building and the lower portion of the wall is adjacent a foundation of the building. The system further includes a shear assembly that fits within a space defined by two adjacent studs positioned laterally along the wall, the upper portion of the wall, and the lower portion of the wall, such that the shear assembly couples the upper portion of the wall to the foundation. The shear assembly includes a deformable coupling assembly having an upper end and a lower end such that a relative lateral displacement of the upper and lower ends causes a restorable deformation followed by a non-restorable deformation of the deformable coupling assembly. The upper end attaches to the upper portion of the wall in a substantially rigid manner. The shear assembly further includes an interconnecting assembly that interconnects the lower end of the deformable coupling assembly to the foundation in a substantially rigid manner such that the deformable coupling assembly couples the upper portion of the wall to the foundation so as to allow energy dissipation by restorable and non-restorable deformation of the deformable coupling assembly in response to a lateral shear force applied to the upper portion of the wall.

The deformable coupling assembly being positioned near the upper portion of the wall and the interconnecting assembly being attached to the foundation in a substantially rigid manner provides a relatively short moment arm for the shear force applied to the upper portion of the wall so that the shear force is countered by the deformable coupling assembly before being transmitted to the foundation. In one embodiment, the deformable coupling assembly includes a plurality of corrugations having a plurality of vertical plates joined by alternating upper and lower joining plates. The upper joining plates and lower joining plates respectively define the upper and lower ends of the deformable coupling assembly.

In one embodiment, the deformable coupling assembly includes a plurality of plates extending in a direction having a vertical component joined to the upper portion of the wall at a plurality of locations and to the interconnecting assembly at a plurality of locations such that the shear force applied to the upper portion of the wall is transmitted to the plurality of plates in a substantially direct manner. In one embodiment, the plurality of plates are formed by a corrugated member having alternating upper and lower joining plates that join a plurality of vertical plates. The upper joining plates and lower joining plates respectively define plurality of joining locations at the upper and lower ends of the deformable coupling assembly.

In one embodiment, the vertical plates act as leaf springs when the lateral displacement is restorable. In one embodiment, the non-restorable deformation of the deformable coupling assembly includes non-restorable bending of the vertical plates. In one embodiment, the non-restorable deformation of the deformable coupling assembly includes non-restorable folding or unfolding of corners defined by the vertical plates and the upper and lower joining plates.

In one embodiment, the system further includes a side coupling that deformably couples one of the studs to at least one of the upper or lower ends of the deformable coupling assembly. The side coupling provides additional energy dissipation during a displacement of the upper portion of the stud relative to the foundation.

In one embodiment, the corrugated deformable coupling assembly is configured so as to allow relatively easy installation and replacement. The corrugated deformable coupling assembly is formed from a strip of ductile metal so as to facilitate relatively easy fabrication. Such corrugated assembly dissipates energy by a combination of shear, bending, and tension of the plates.

In one embodiment, the corrugated deformable coupling assembly further includes a filler material interposed between the vertical plates so as to adjust the effects of the shear force. The filler material can be a material such as rubber or RUMBER.

In one embodiment, the wall includes a light metal frame. In one embodiment, the wall includes a wood frame. The deformable coupling assembly being able to deform in restorable and non-restorable deformation manners allows for greater flexibility in the design of energy dissipating characteristics of the coupling between the upper portion of the wall and the foundation.

In one embodiment, the interconnecting assembly includes an A-frame structure. In one embodiment, the interconnecting assembly includes a panel. In one embodiment, the interconnecting assembly includes a braced frame.

In one embodiment, the deformable coupling assembly in response to a reversed cyclic shear force deforms during each displacement of the top portion of the wall relative to the foundation, thereby increasing the energy dissipation of the reversed cyclic shear force. In one embodiment, the deformation of the deformable coupling assembly has a substantially hysteretic behavior resulting in larger reductions in earthquake effects, including forces and energy, that are imposed on light frame structures by a seismic event.

Another aspect of the present teachings relates to a system for reducing the effects of shear forces on a building structure. The system includes a wall comprising a plurality of vertical studs. The wall includes an upper portion and a lower portion, and the upper portion of the wall is adjacent the upper portion of the building and the lower portion of the wall is adjacent a foundation of the building. The system further includes a shear assembly that fits within a space defined by two adjacent studs positioned laterally along the wall, the upper portion of the wall, and the lower portion of the wall, such that the shear assembly couples the upper portion of the wall to the foundation. The shear assembly includes a deformable coupling assembly having a plurality of deformable members that extend along a direction having a vertical component. The shear assembly further includes an interconnecting assembly that interconnects the lower end of the deformable coupling assembly to the foundation in a substantially rigid manner. The plurality of deformable members are attached to the upper portion of the wall at a plurality of upper attachment locations in a substantially rigid manner. The plurality of deformable members are attached to the interconnecting assembly at a plurality of lower attachment locations in a substantially rigid manner, so that a shear force acting on the upper portion of the wall is transmitted substantially directly to the plurality of deformable members.

In one embodiment, the plurality of deformable members include a plurality of plates. In one embodiment, the plurality of plates are formed by a corrugated member having alternating upper and lower joining plates that join a plurality of vertical plates. The upper joining plates and lower joining plates respectively define plurality of joining locations at the upper and lower ends of the deformable coupling assembly.

In one embodiment, the vertical plates act as leaf springs when the lateral displacement is restorable. In one embodiment, the non-restorable deformation of the deformable members includes non-restorable bending of the vertical plates. In one embodiment, the non-restorable deformation of the deformable members includes non-restorable folding or unfolding of corners defined by the vertical plates and the upper and lower joining plates.

In one embodiment, the system further includes a side coupling that deformably couples one of the studs to at least one of the upper or lower ends of the deformable coupling assembly. The side coupling provides additional energy dissipation during a displacement of the upper portion of the stud relative to the foundation.

In one embodiment, the corrugated deformable coupling assembly is configured so as to allow relatively easy installation and replacement. The corrugated deformable coupling assembly is formed from a strip of ductile metal so as to facilitate relatively easy fabrication. Such corrugated assembly dissipates energy by a combination of shear, bending, and tension of the plates.

In one embodiment, the corrugated deformable coupling assembly further includes a filler material interposed between the vertical plates so as to adjust the effects of the shear force. The filler material can be a material such as rubber or RUMBER.

In one embodiment, the wall includes a light metal frame. In one embodiment, the wall includes a wood frame. The deformable coupling assembly being able to deform in restorable and non-restorable deformation manners allows for greater flexibility in the design of energy dissipating characteristics of the coupling between the upper portion of the wall and the foundation.

In one embodiment, the interconnecting assembly includes an A-frame structure. In one embodiment, the interconnecting assembly includes a panel. In one embodiment, the interconnecting assembly includes a braced frame.

In one embodiment, the deformable coupling assembly in response to a reversed cyclic shear force deforms during each displacement of the top portion of the wall relative to the foundation, thereby increasing the energy dissipation of the reversed cyclic shear force. In one embodiment, the deformation of the deformable coupling assembly has a substantially hysteretic behavior resulting in larger reductions in earthquake effects, including forces and energy, that are imposed on light frame structures by a seismic event.

Yet another aspect of the present teachings relates to a coupling assembly for a shear assembly. The coupling assembly is interposed between an upper portion of the wall and an interconnecting assembly. The interconnecting assembly is substantially rigidly mounted to a foundation and includes a top mounting member. The coupling assembly includes a plurality of deformable members having a first end and a second end. The plurality of deformable members extend along a direction having a vertical component. The coupling assembly further includes a plurality of first attachments that substantially firmly attach the plurality of deformable members to the upper portion of the wall. The coupling assembly further includes a plurality of second attachments that substantially firmly attach the plurality of deformable members to the top mounting member. A force that causes a relative displacement of the upper portion of the wall and the foundation is transmitted to the plurality of deformable members in a substantially direct manner via the plurality of first or second attachments so as to cause the plurality of deformable members to undergo a non-restorative deformation for a substantial portion of the relative displacement so as to dissipate the force.

In one embodiment, the deformable members includes a plurality of plates extending in a direction having a vertical component interposed between the first and second attachments. In one embodiment, the plurality of plates are part of a corrugated strip having alternating upper and lower joining sections such that the first attachments form attachment of the upper joining sections to the upper portion of the wall and the second attachments form attachment of the lower joining section to the top mounting member of the interconnecting assembly. The corrugated strip can be formed from a strip of ductile metal so as to facilitate relatively easy fabrication, installation, and replacement. The corrugated deformable coupling assembly dissipates energy by a combination of shear, bending, and tension of the plates.

In one embodiment, the coupling assembly further includes a filler material interposed between the plates so as to adjust the effects of the force on the coupling assembly. The filler material can be materials such as rubber or RUMBER.

In one embodiment, the plurality of deformable members respond to a reversed cyclic shear force at the top portion of the wall by deforming during each displacement of the top portion of the wall relative to the foundation, thereby increasing the energy dissipation of the reversed cyclic shear force. In one embodiment, the deformation of the deformable members has a generally substantially hysteretic behavior resulting in larger reductions in earthquake effects, including forces and energy, that are imposed on light frame structures by a seismic event.

BRIEF DESCRIPTION OF THE DRAWINGS

These and other aspects, advantages, and novel features of the present teachings will become apparent upon reading the following detailed description and upon reference to the accompanying drawings. In the drawings, similar elements have similar reference numerals.

DETAILED DESCRIPTION OF THE SOME EMBODIMENTS

This application is a continuation-in-part of U.S. patent application Ser. No. 09/932,181, filed on Aug. 17, 2001, entitled "A-FRAME SHEAR ASSEMBLY FOR WALLS," which is hereby incorporated by reference in its entirety.

Figure 1:
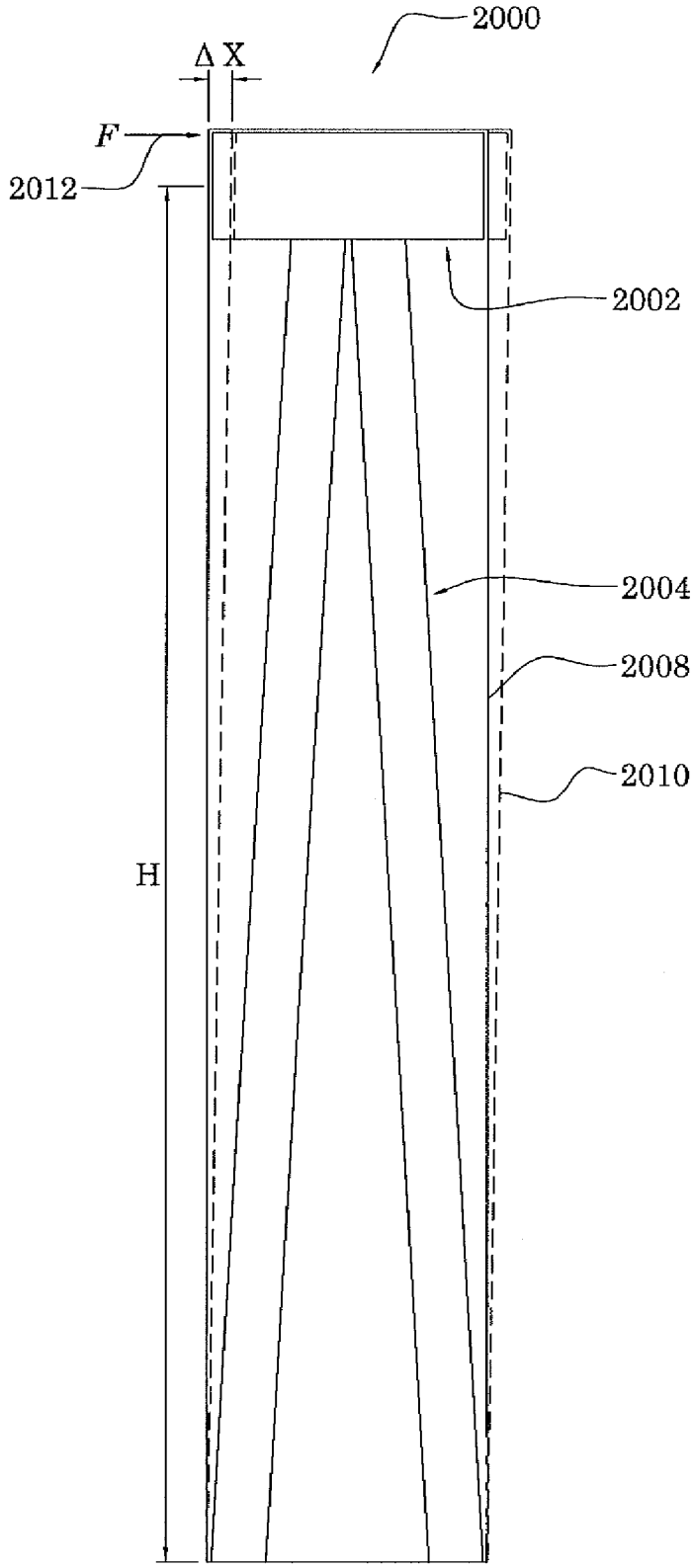
FIG. 1 shows a block diagram of one embodiment of a shear assembly having a deformable energy-dissipating member that dissipates a shear force at a selected location that results in a relatively short moment arm associated with the shear force acting near the top of a frame wall.

The present teachings relate to a deformable energy dissipating assembly that couples the top portion of a wall frame to the foundation. FIG. 1 shows a block diagram of one embodiment of a shear assembly 2000 having a deformable energy dissipating assembly 2002. As described below, the energy dissipating assembly 2002 can be attached to the top portion of a frame 2008 in different manners. The energy dissipating assembly 2002 can also be attached to an interconnecting assembly 2004 so that the interconnecting assembly 2004 couples the energy dissipating assembly 2002 to a foundation 2006.

As described below in greater detail, the shear assembly 2000 can be implemented in light metal frame structures as well as wood frame structures. The shear assembly 2000 can be pre-fabricated so as to include its own rectangular shaped frame that is dimensioned to fit within one of the wall frame's rectangular area defined by the wall's top, bottom, and vertical sections. Alternatively, the shear assembly 2000 can be installed between the existing vertical sections (studs, for example) so that the existing top, bottom, and vertical sections define the frame for the shear assembly 2000.

In one embodiment, the shear assembly 2000 is mounted substantially firmly to the foundation 2006, and the energy dissipating assembly 2002 is located at the top end of the interconnecting assembly 2004. Thus, an energy dissipating coupling between the assembly 2002 and the top portion of the frame 2008 is located from the foundation 2006 by a distance of approximately H. By providing a relatively rigid platform for the energy dissipating coupling with respect to the foundation, a force F (denoted by an arrow 2012) acting on the top portion of the frame 2008 is given a relatively short moment arm with respect to the lower portion of the frame. Consequently, the force F is countered by the energy dissipating coupling before it can have a long-moment-arm effect on the lower portion of the frame.

FIG. 1 also shows the force 2012 causing the top portion of the frame 2008 to be displaced by an amount $\Delta X$ relative to the foundation 2006. The displaced frame is denoted by a dashed frame 2010. The interconnecting assembly 2004 is shown to be generally stationary with respect to the foundation 2006. In one embodiment, the energy dissipating assembly 2002 is mounted substantially firmly to the top of the interconnecting assembly 2004. Thus, relative movement of the top of the frame 2008 with respect to the interconnecting assembly (and thus the foundation 2006) due to the force 2012 is "absorbed" by the energy dissipating assembly 2002.

Figure 2:
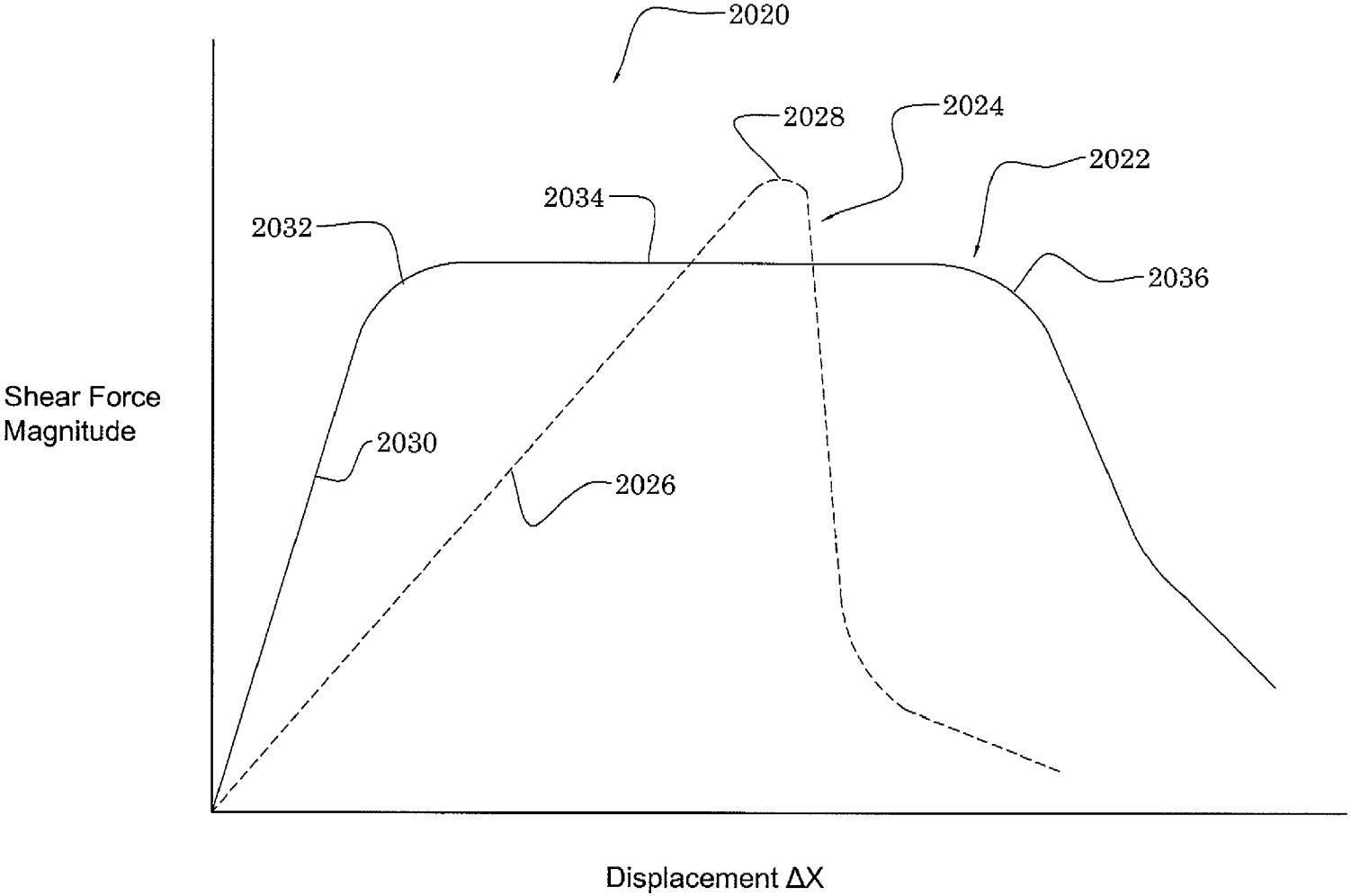
FIG. 2 shows an example response of the energy-dissipating member when subjected to a shear force.

FIG. 2 now shows an example response 2020 of one embodiment of the energy dissipating assembly. An example curve 2022 shows how the relative displacement $\Delta X$ can occur within the assembly in response to the shear force. For comparison, an example curve 2024 (dotted curve) representative of a spring device is shown. In one assumes an ideal spring behavior for the spring device, the spring's restorative force is proportional to the spring displacement (compressed or stretched). Thus, the spring device's response to the shear force includes a generally linear portion 2026. Once the spring's mechanical limit (indicated by 2028) is reached (for example, when unable to compress further), the spring's response changes substantially abruptly. Such a change and subsequent behavior is indicated by a relatively sharp drop-off in the displacement response to the shear force. That is, the spring is unable to accommodate the shear force beyond the mechanical limit, and the shear force beyond that limit is transferred to the frame.

The spring device can be configured by selecting the spring's stiffness (spring constant) and/or the amount the spring is allowed to compress or stretch. Thus, the response curve 2024 can be adjusted to some degree. However, the useful spring restorative response is still limited to a generally linear response.

In one embodiment of the energy dissipating assembly, its response curve 2022 can include a generally linear restorative portion 2030 and a non-restorative portion 2034. As described below in greater detail, an energy dissipating element of the energy dissipating assembly can be configured so that for a first range of displacement (of one portion of the element with respect to another portion), the element can be restored to its original configuration in a spring-like manner. Beyond the first range of displacement, as indicated by a restorative limit 2032, the element deforms for a second range of displacement until it reaches a deformation limit 2036. Beyond the deformation limit 2036, the shear force is transferred to the frame.

One can see that the energy dissipating assembly allows for more variations in the shear force response configuration. For example, the steepness and range of the restorative response can be selected as desired for a given application. Similarly, the range and the manner in which deformation occurs can be selected. Thus, it will be understood that the response curves 2022 and 2024 are examples for the purpose of description. The restorative portion 2030 of the curve 2022 may be less steep than that of the curve 2024. Also, the restorative limit 2032 of the curve 2022 may occur at a greater displacement than the limit 2028 of the curve 2024

One way to provide the restorative and deformable response of the energy dissipating assembly is to couple the interconnecting assembly and the top of the frame with one or more plates. Each plate can act as a leaf spring in the restorative range, and can deform when displaced beyond the restorative limit.

Figure 3A:
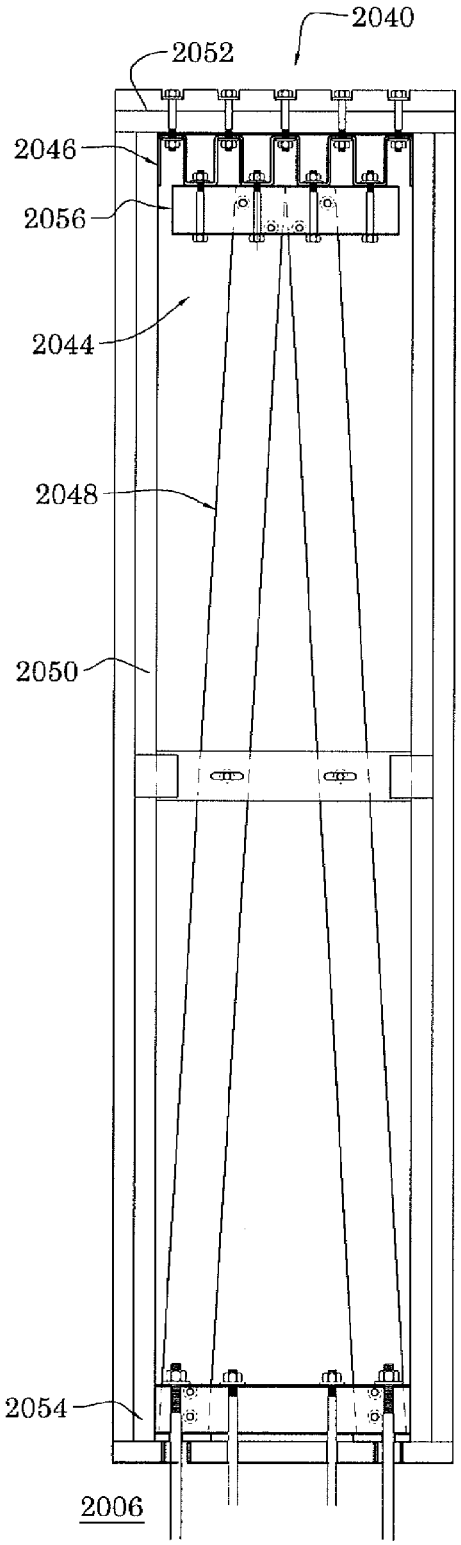
FIGS. 3A and B show deformation of one embodiment of the energy-dissipating member when subjected to a shear force.

FIGS. 3A and B show one embodiment of an energy dissipating assembly 2044 having a plurality of plates 2046 that couple an interconnecting assembly 2048 to a top section 2052. The top portions of the plates 2046 are fastened to the top section 2052, and the bottom portions of the plates 2046 are fastened to the interconnecting assembly 2048 via a mounting member 2056. The bottom of the interconnecting assembly 2048 is shown to be secured to the foundation 2006 via a bottom mounting assembly 2054. Examples of bottom mounting assemblies are described below in greater detail.

FIGS. 3A and B further show that interconnecting assembly 2048 and energy dissipating assembly 2044 fit inside two vertical sections 2050. As previously described, the vertical sections 2050 can be part of the existing wall frame, or part of a pre-fabricated assembly (including the interconnecting assembly and the energy dissipating assembly) that fits in the existing wall frame.

FIG. 3A shows an at-rest configuration 2040 of the section of the wall having the energy dissipating assembly 2044. In one embodiment, the plates 2046 in such a configuration are in a generally vertical orientation.

Figure 3B:
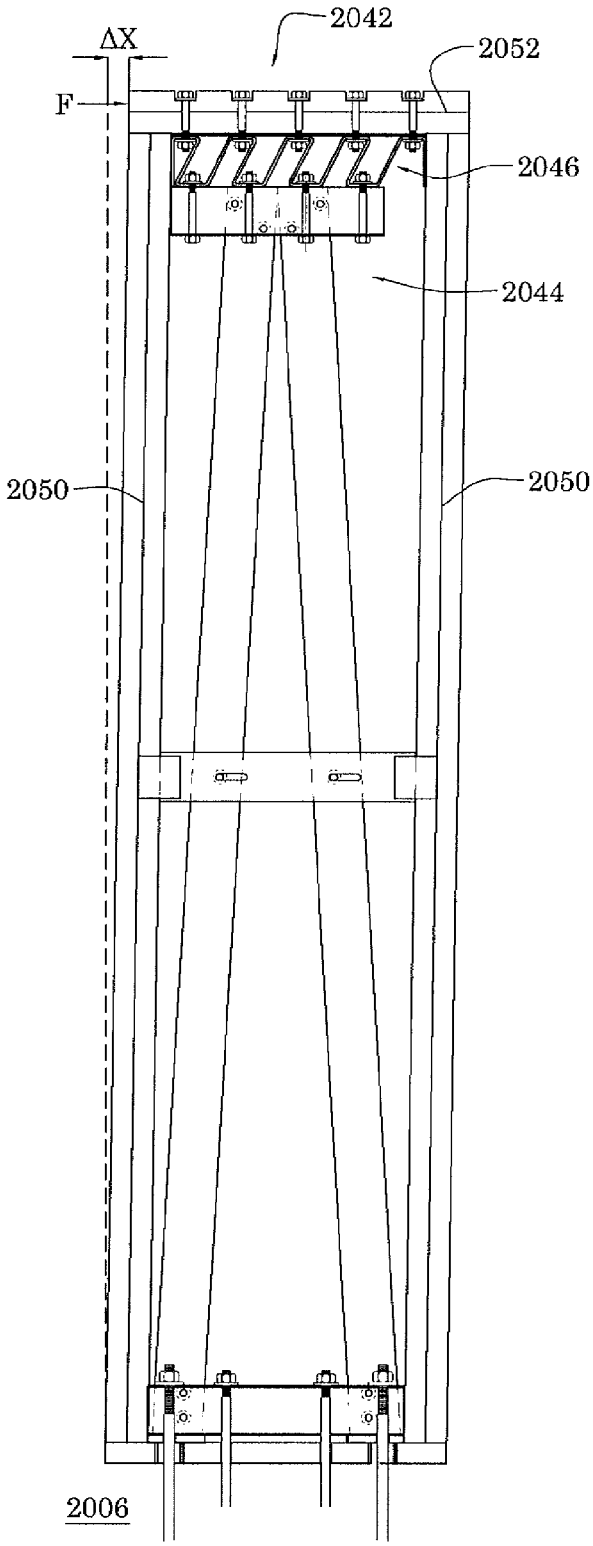

FIG. 3B shows a configuration 2042 of the section of the wall subjected to a shear force that causes the top section 2052 to be displaced by an amount $\Delta X$ relative to the foundation 2006. The plates 2046 are shown to be deformed in response to the displacement.

As is generally known, each of the plates 2046 can act as a leaf spring. Thus, when subjected to a displacement within its restorative range, the plate can be restored to its vertical orientation when the shear force is removed. When the shear force continues the displacement beyond the restorative limit, the plate is deformed, thereby dissipating the energy associated with the shear force.

The deformation of the plate is depicted in a simplified manner as being angled in FIG. 3B. It will be appreciated, however, that the deformation can cause the plate to bend. Furthermore, the energy dissipating deformation may also include deformation of connecting structures that connect the plate to the top section 2052 and the mounting member 2056. For example, the example embodiment of the plates 2046 shown in FIGS. 3A and B form a corrugation so that the top grooves are fastened to the top section 2052 and the bottom grooves are fastened to the mounting member 2056. When such a corrugation is subjected to a shear force, the resulting deformation can deform the bends at the top and bottom grooves as well. In one embodiment, such deformation of structures about the plate occurs after the displacement exceeds the restorative range of the plate.

Figure 4A:
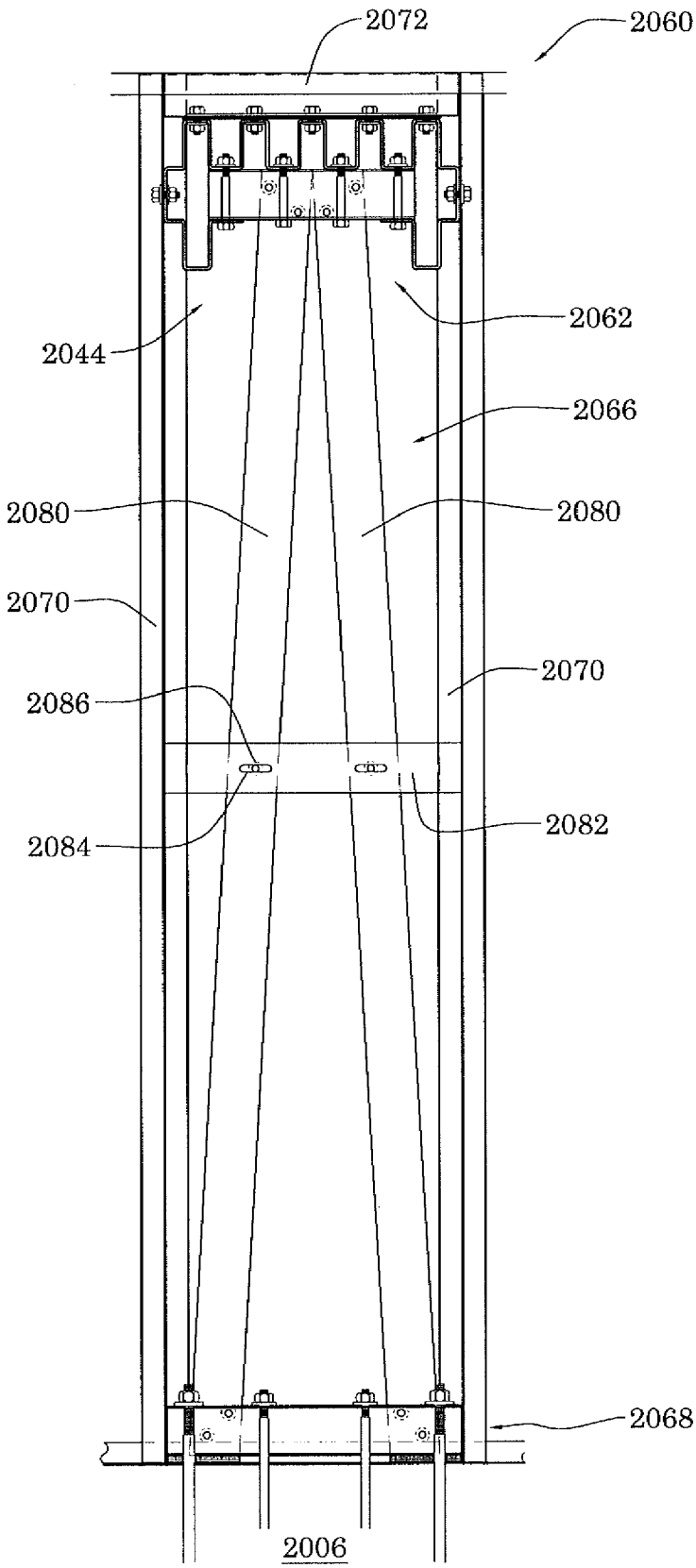
FIG. 4A shows one embodiment of a shear assembly that is adapted for use in light metal frame structures.

FIGS. 4A-I now show one embodiment of a shear assembly 2060 adapted for light metal frame structures. As shown in FIG. 4A, the shear assembly 2060 includes an energy dissipating assembly 2062 that couples a top section 2072 to an interconnecting assembly 2066. The energy dissipating assembly 2062 is attached to the interconnecting assembly 2066 in a substantially firm manner. The interconnecting assembly 2066 is attached to the foundation 2006 in a substantially firm manner via a base mounting assembly 2068. Thus, the energy dissipating assembly 2062 couples the top section 2072 to the foundation 2006 in a restorable and deformable manner at a location that provides a relatively short moment arm to a shear force acting on the top section 2072.

In one embodiment, the interconnecting assembly 2066 and the energy dissipating assembly 2062 are dimensioned to generally fit between two vertical sections 2070. The vertical sections 2070 can be part of the existing light metal frame wall, or part of a pre-fabricated assembly. The thickness (dimension in and out of plane of FIG. 4A) of the interconnecting assembly 2066 and the energy dissipating assembly 2062 are also selected to allow flush mounting of flat panels to the vertical sections 2070.

In the description herein, the interconnecting assembly is in the form of an A-frame. It will be appreciated, however, that other structures can couple the foundation to the energy dissipating assembly in a secure manner without departing from the spirit of the present teachings.

The example A-frame interconnecting assembly 2066 includes two legs 2080 arranged in an "A" configuration. As shown in FIG. 4A, the shear assembly 2060 may further include a brace 2082 that braces the mid-portion of the two legs 2080. In one embodiment, the brace 2082 is securely attached to the two vertical sections 2070, and defines horizontal slots 2084 that permit horizontally slidable coupling of the legs 2080 to the brace 2082 (via bolts 2086). Thus, the brace 2082 inhibits buckling of the legs in a direction in and out of the plane of FIG. 4A, and allows the vertical sections 2070 to be displaced in a generally horizontal manner with respect to the interconnecting assembly 2066.

Figures 4B, 4C, 4D:
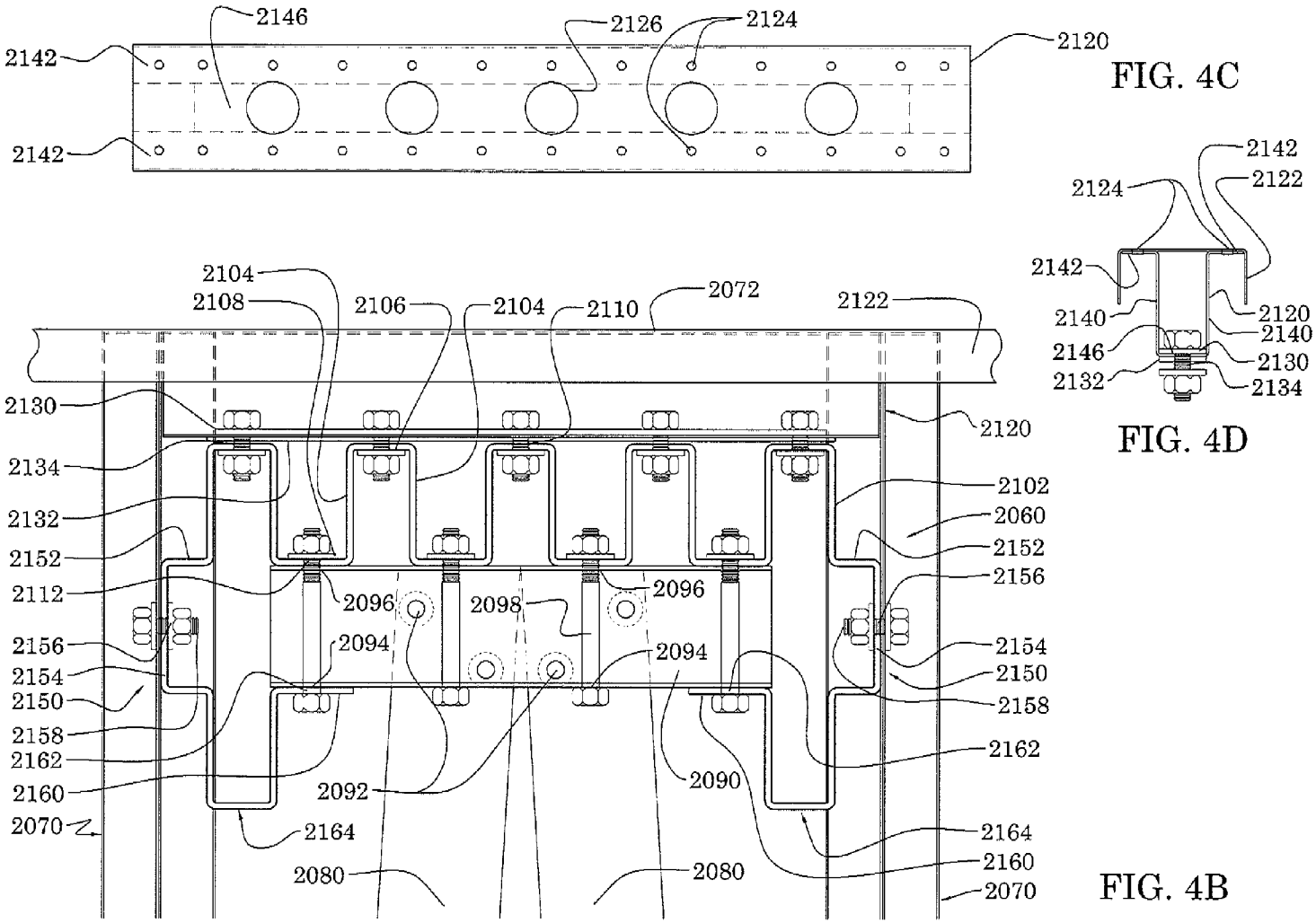
FIG. 4B shows one embodiment of the energy-dissipating member of the shear assembly of FIG. 4A.
FIG. 4C shows one embodiment of a connecting piece that connects the energy dissipating member of FIG. 4B to the top portion of the light metal frame.
FIG. 4D shows a cross-sectional view of the connecting piece of FIG. 4C attached to a top rail that forms the top portion of the light metal frame.

FIGS. 4B-F show various views of parts associated with the energy dissipating assembly 2062. FIG. 4B shows a close-up of the assembly 2026, and how it is attached to the legs 2080 of the interconnecting assembly (2066 in FIG. 4A) and coupled to the top section 2072.

In one embodiment, the coupling and energy dissipating function of the assembly 2062 is provided by a plurality of deformable plates 2104 joined at the top and bottom in an alternating manner so as to form a plurality of corrugations 2102. Adjacent plates 2104 are joined at the top by a top joining plate 2106 that defines a mounting hole 2110. The mounting holes allow attachment of the top joining plates 2106 to the top section 2072 in a manner described below. A bottom joining plate 2108 joins adjacent plates 2104 at the bottom so that bottom joining plates 2108 and top joining plates 2106 alternate in the corrugation pattern. The bottom joining plates 2108 define mounting holes 2112 that allow attachment of the bottom joining plates 2108 to the legs 2080 in a manner described below.

In one embodiment, the plurality of corrugations 2102 are attached to the top section 2072 in the following manner. An inverted-hat shaped channel 2120 that extends laterally parallel to the top section 2072 joins the top joining plates 2106 of corrugations 2102 to an inverted C-shaped top rail 2122 that forms the top section 2072. The inverted-hat channel 2120 has a cross-sectional shape including a hat-top 2146 that joins two hat-sides 2140 so as to form a U-shape (with the hat-top being the bottom of the "U"). Hat-brims 2142 extend outward and are generally parallel to the hat-top 2146. The hat-brims 2142 are dimensioned to fit within the top rail 2122, and are attached to the inside inverted C-shaped top rail 2122. In one embodiment, the attachment of the hat-brims 2142 to the top rail 2122 is achieved by a plurality of clinches 2124, thereby firmly attaching the inverted-hat channel 2120 to the top section 2072.

The hat-top section 2146 defines a plurality of mounting holes 2126 that substantially align with the holes 2110 when the hat-top section 2146 is positioned above the top joining plates 2106. A fastener 2134 extends through the holes 2126 and 2110 so as to mount the top joining plates 2106 to the hat-top 2146 and thus to the top section 2072. In one embodiment, the fastener 2134 is a bolt that is secured with a nut. In one embodiment, mounting plates 2130 and 2132 (not shown in FIG. 4E, and having holes that match the holes 2126 and 2110) are positioned above and below the hat-top section 2146 to act as strengthen the mounting of the top joining plates 2106 to the hat-top 2146.

In one embodiment, the plurality of corrugations 2102 are attached to the legs 2080 of the interconnecting assembly 2066 in the following manner. As shown in a side sectional view in FIG. 4F, each leg 2080 of the interconnecting assembly is formed by two hollow posts having a rectangular cross-sectional shape (each hollow post is also denoted as 2080). Thus in one embodiment, the interconnecting assembly includes two layers of "A" shaped legs. Interposed between the two layers of legs is a top cross member 2090 that extends horizontally and joins the tops of the legs.

Figure 4E:
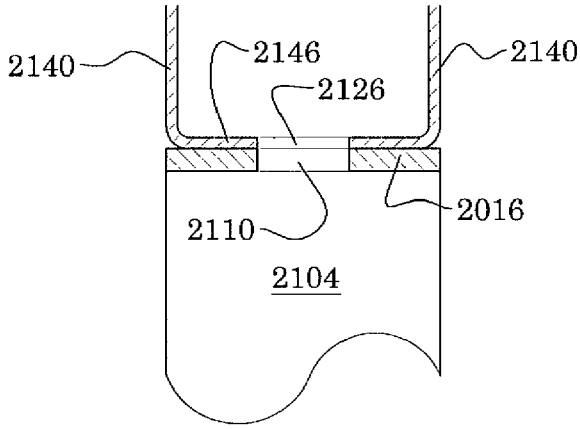
FIG. 4E shows a cross-sectional view of how one embodiment of the energy dissipating member is attached to the connecting piece of FIG. 4C.
Figure 4F:
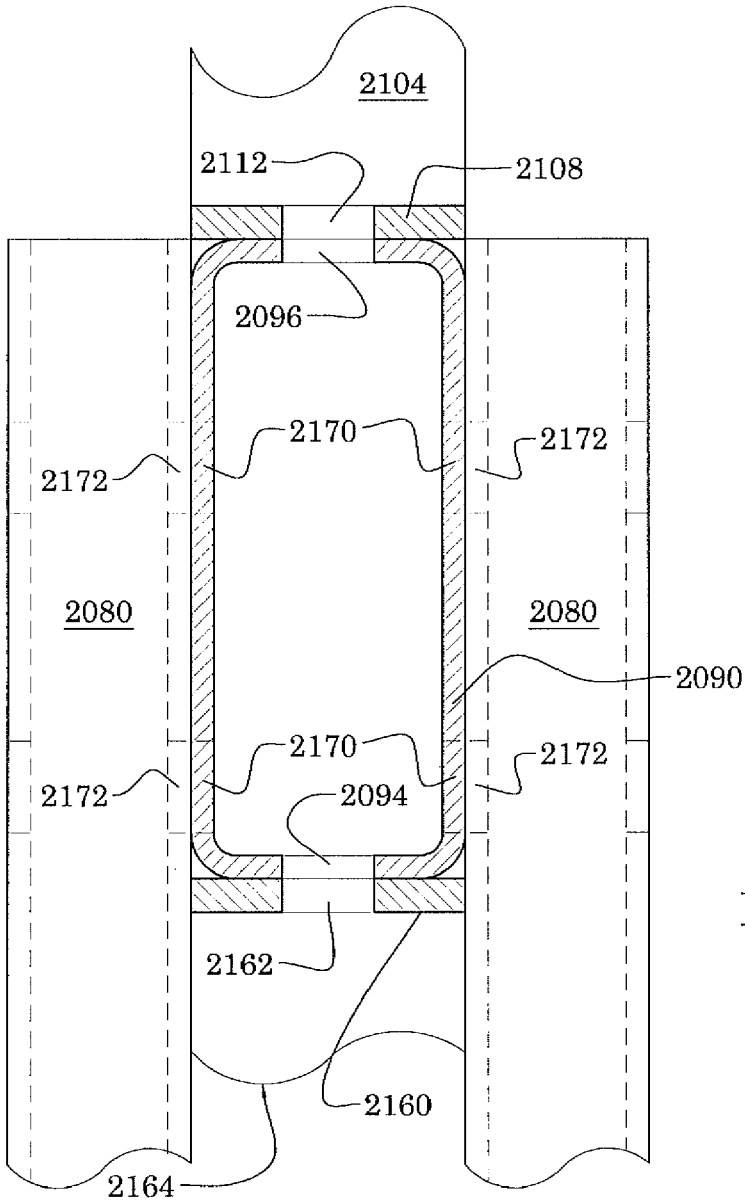
FIG. 4F shows a cross-sectional view of how one embodiment of the energy-dissipating member is attached to an interconnecting member that interconnects the energy-dissipating member to a base of the shear assembly.

In one embodiment, the top cross member 2090 is a hollow post having a rectangular cross-sectional shape and cut in length to accommodate the attachment of the corrugations 2102. As shown in FIGS. 4B and F, side walls of the top cross member 2090 defines mounting holes 2170 that matches with mounting holes 2172 defined near the top of the legs 2080. The holes 2170 and 2172 lined up can receive mounting bolts 2092 that secure the tops of the legs 2080 in a substantially rigid manner. As shown in FIG. 4F, holes defined on the outer sides of the legs and in-line with the holes 2170 and 2172 can be made larger to allow bolt heads and nuts to pass through. Such recessed mounting of the mounting allows bolts 2092 to be secured without protruding beyond the outer sides of the legs.

As shown in FIGS. 4B and F, the top cross member 2090 that firmly secures the tops of the legs 2080 is positioned so that its top side is underneath the bottom joining plates 2108 of the corrugations 2102. The top side (of the top cross member 2090) defines a plurality of mounting holes 2096 that align with the holes 2112 on the bottom joining plates 2108. The bottom side (of the top cross member 2090) also defines a plurality of mounting holes 2094 that are in-line with the holes 2112 and 2096. A fastener such as a bolt 2098 extends through each set of in-line mounting holes 2112, 2096, and 2094, thereby securing the corresponding bottom joining plate 2108 to the top cross member 2090 and thus to the legs 2080.

As further shown in FIGS. 4B and F, the energy dissipating assembly 2062 may also include additional couplings between the legs 2080 and the top portions of the vertical sections 2070. Such couplings can provide flexibility in the design of the operating characteristics of the energy dissipating assembly and the manner in which the assembly is installed.

In one embodiment, the additional couplings include a side coupling 2050 that couples the legs 2080 to the top portion of the vertical sections 2070. In one embodiment, each vertical section 2070 is formed by two C-channels joined back-to-back (as shown in the cross-sectional view in FIG. 4H, and also referred to as web-to-web). The side coupling 2050 includes a bottom plate 2152 that extends laterally outward from the bottom of the outer-most deformable plates 2104 into the "C" of the inner C-channel (of the vertical section 2070). The bottom plate 2152 then bends downward to form a side plate 2154. The side plate defines a mounting hole 2156 that allows a fastener such as a bolt 2158 to secure the side plate to the backs (webs) of the "C"s of the vertical section 2070.

In one embodiment, the additional couplings further include a lower coupling 2164 that couples the vertical section/top section "side" to the bottom of the cross member 2090. In one embodiment, the lower coupling 2164 is connected to the side coupling 2150 by a lower lateral plate that is a substantial mirror image (about the horizontal line that extends through the middle of the cross member 2090) of the bottom plate 2152. The lower lateral plate is connected to a structure that is a mirror image to the two outermost deformable plates 2104 and the corresponding outermost bottom joining plate 2108. The mirror image of the outermost bottom joining plate 2108 is denoted as a mounting plate 2160 that defines a mounting hole 2162 for receiving the outermost fastener 2098.

In one embodiment, the corrugations 2102, side couplings 2150, and lower coupling 2164 are formed from a single piece of an approximately 50 ksi steel of 10 gauge or thicker. As shown in FIGS. 4E and F, one embodiment of the single-piece coupling member can be formed from a strip of such a metal, where the strip has a width similar to the thickness of the cross member 2090. In one embodiment, the cross-member 2090 has a cross-sectional dimension of approximately 1.5"×3.5", and thus the width of the strip as shown has a width of approximately 1.5". It will be appreciated that the strip can have other widths and provide the energy dissipating function. One can see that the deformation property of the strip can be adjusted by adjusting the width of the strip.

Preferably, the width of the strip is no larger than the combined thickness of the two layers of the legs 2080 with the cross member 2090 sandwiched therebetween (FIG. 4F) so that the strip does not interfere with flush fitting of the shear assembly in a wall frame. In the embodiment where the vertical sections 2070 are back-to-back (web-to-web) C-channels, the width of the strip is preferably selected to allow the side coupling to fit within the lips of the inward facing C-channels.

Aside from the material, thickness, and width of the deformable plates 2104, there are numerous ways of adjusting the deformation and other mechanical properties of the coupling. For example, the height of the deformable plates 2104 can be adjusted. The number of deformable plates 2104 (number of corrugations 2102) can be adjusted as well. Thus, one can see that the energy dissipating coupling can be configured in numerous ways to suit different structural design requirements and applications. Some design considerations may include, but are not limited to, type of structure, vertical load bearing capability of the coupling at rest, and the coupling's restorative and deforming response to a shear force.

Figure 4G:
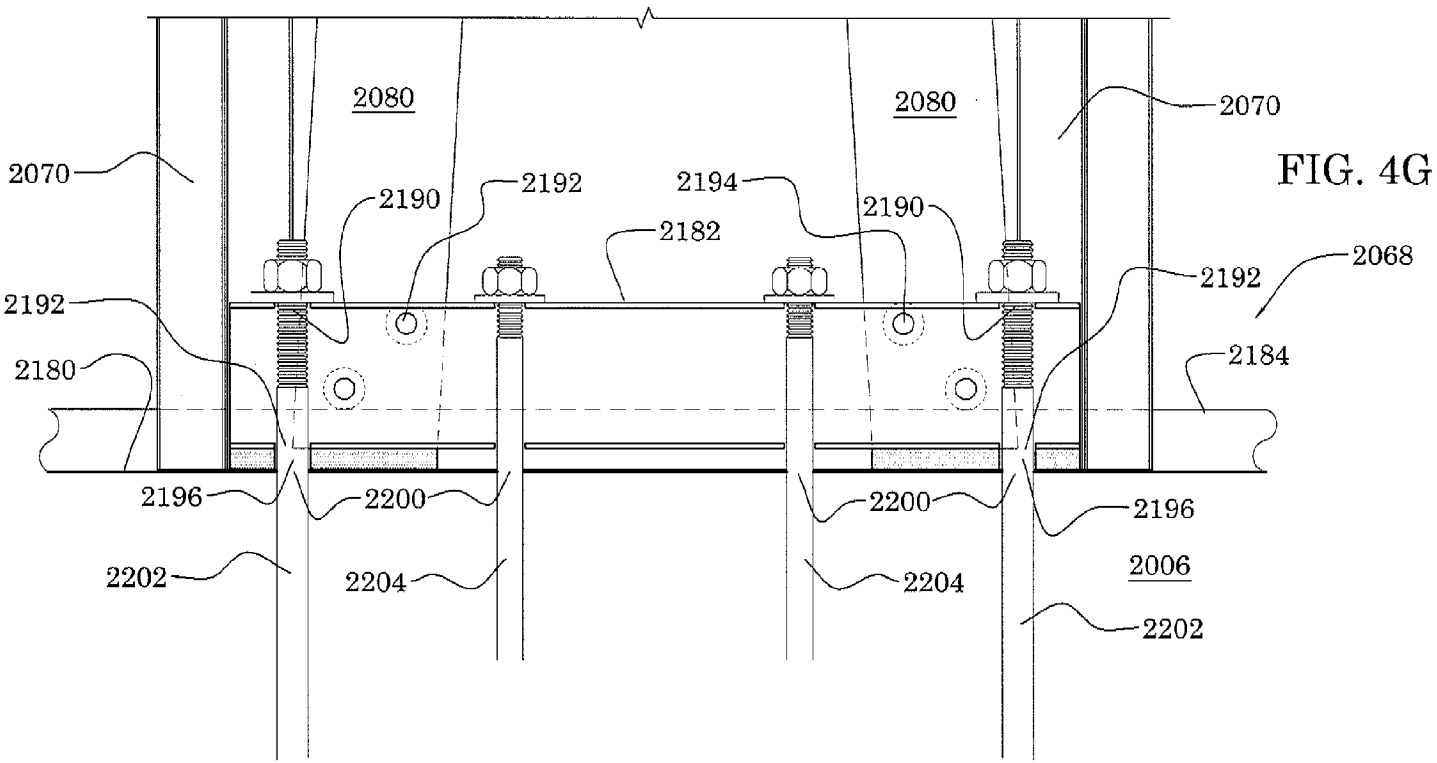
FIG. 4G shows one embodiment of the base that connects the shear assembly to a foundation that supports the light metal frame.
Figure 4H:
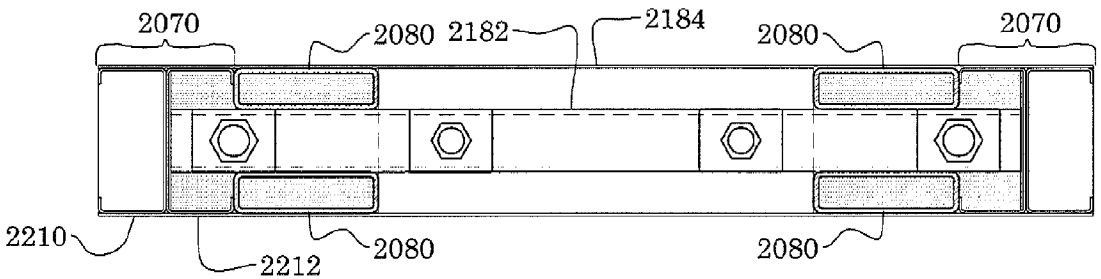
FIG. 4H show a top cross-sectional view of the base of FIG. 4G.
Figure 4I:
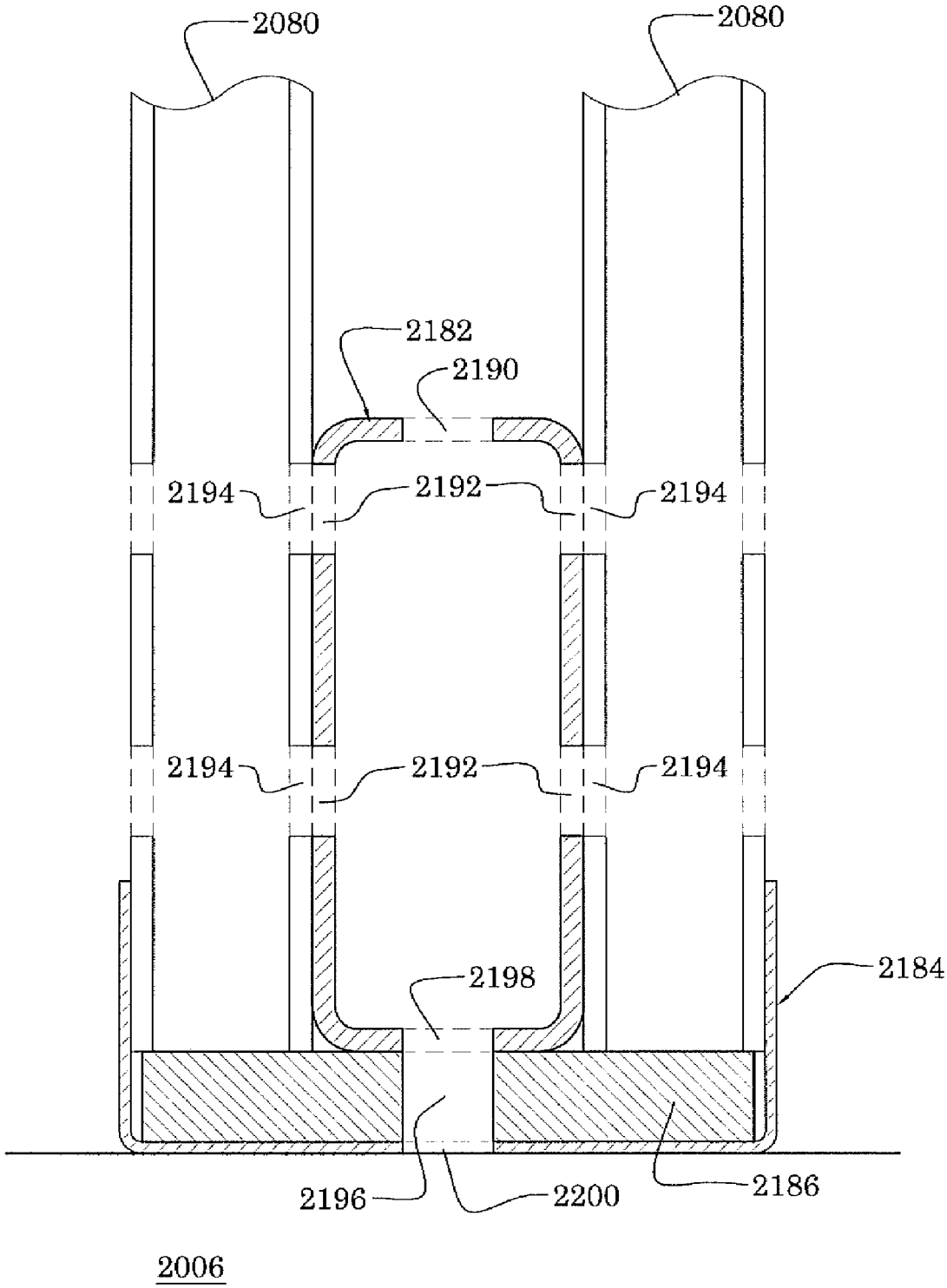
FIG. 4I shows a side cross-sectional view of the base of FIG. 4G.

FIGS. 4G-I now show details of one embodiment of the base mounting assembly 2068 that mounts the interconnecting assembly to the foundation in a substantially rigid manner. FIG. 4G is a front sectional view, FIG. 4H is a top sectional view, and FIG. 4I is a side sectional view. As previously described herein, the substantially rigid mounting of the interconnecting assembly to the foundation provides a relatively short moment arm for the shear force acting on the top portion of the wall frame. As such, the shear force is countered by the energy dissipating coupling before the shear force (if any left over) is transmitted to the base mounting assembly with a longer moment arm.

For the shear assembly adapted for light metal frame structure (FIGS. 4A-I), one embodiment of the base mounting assembly 2068 anchors the interconnecting assembly to the foundation in the following manner. As described above in reference to FIG. 4F, one embodiment of the interconnecting assembly includes two layers of A-shaped legs 2080.

For such an arrangement, the bottom portions of the legs 2080 are secured to each other via a bottom cross member 2182. In one embodiment, the bottom cross member 2182 is a longer version of the top cross member 2090, and has a length to fit between inner C-channels 2212 (FIG. 4H) of the vertical section 2070. As shown in FIG. 4I, the sides of the bottom cross member 2182 define mounting holes 2192 that align with mounting holes 2194 defined at the bottom portions of the legs 2080. The aligned holes 2192 and 2194 allow the legs 2080 to be secured to the bottom cross member 2182 via fasteners such as bolts 2192. Similar to the top cross member, the outer sides of the legs 2080 define enlarged holes aligned with the holes 2192 and 2194 so as to allow passage and recessed positioning of bolt heads or nuts. Assembled in the foregoing manner, the legs 2080 secured by top and bottom cross members 2090 and 2182 form a substantially rigid interconnecting structure.

In one embodiment, the top side of the bottom cross member 2182 defines a plurality of mounting holes 2190, and the bottom side defines a plurality of mounting holes 2198 that generally align vertically with the holes 2190. As shown in FIG. 4G, the mounting holes 2190 and 2198 receive anchors such as bolts 2202 and 2204 that protrude from the foundation 2006. In one embodiment, the outer set of anchor bolts 2202 resist the uplifting forces placed on the interconnecting assembly, and the inner set of anchor bolts 2204 resist lateral movement of the interconnecting assembly.

In one embodiment, bottom ends of the vertical sections 2070 and legs 2080 are positioned within a space defined by a bottom rail 2184 that sits on the surface 2180 of the foundation 2006. In one embodiment, the base mounting assembly 2068 can further include compression plates 2186 interposed between the ends of the legs 2080 and the bottom rail 2184. Such plates 2186 can distribute downward forces of the legs placed on the surface 2180 of the foundation 2006.

In one embodiment, various components of the shear assembly described above in reference to FIGS. 4A-I have the following dimensions and properties. The inverted-hat channel 2120 is formed from an approximately 33 ksi or greater steel of 18 gauge or thicker. The top and bottom cross members 2090 and 2182 are steel hollow posts (tubes) having an outer cross-sectional dimension of approximately 3.5"×1.5" and the wall thickness of approximately 16 gauge or thicker. The length of the top cross member 2090 can be selected to accommodate the top ends of the legs 2080, and also to limit the lateral displacement (example in FIG. 3B) of the top portion of the vertical sections 2070. The length of the bottom cross member 2182 is selected to accommodate the bottom ends of the legs 2080, and to fit between the vertical sections 2070. Each of the legs 2080 is a hollow steel post (tube) having an outer cross-sectional overall thickness of approximately 1" and the wall thickness of approximately 16 gauge or thicker. The length of each leg 2080 can be selected to allow the desired "A" configuration and to accommodate the energy dissipating assembly at the top.

Figure 5A:
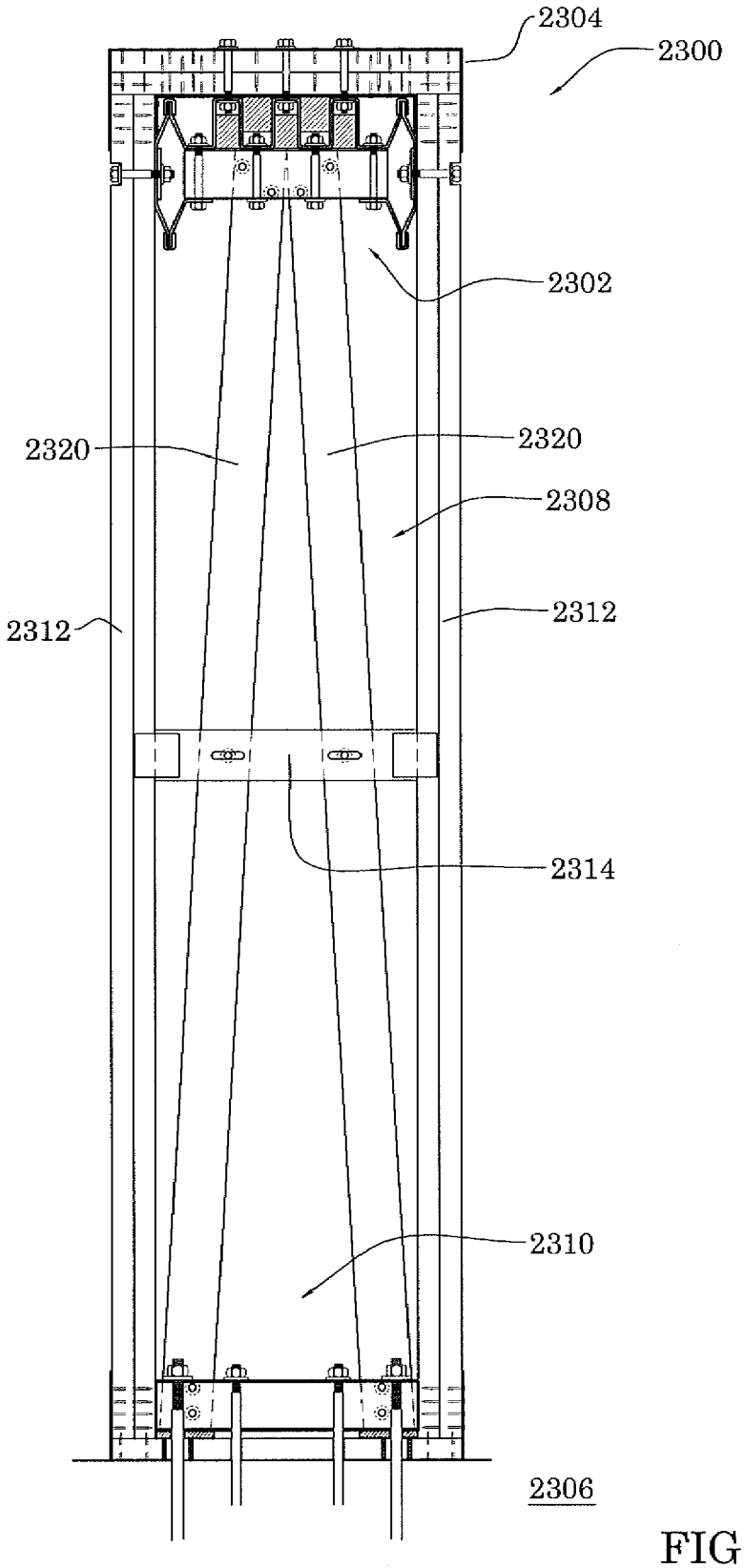
FIG. 5A shows one embodiment of a shear assembly that is adapted for use in wood frame structures.
Figure 5B:
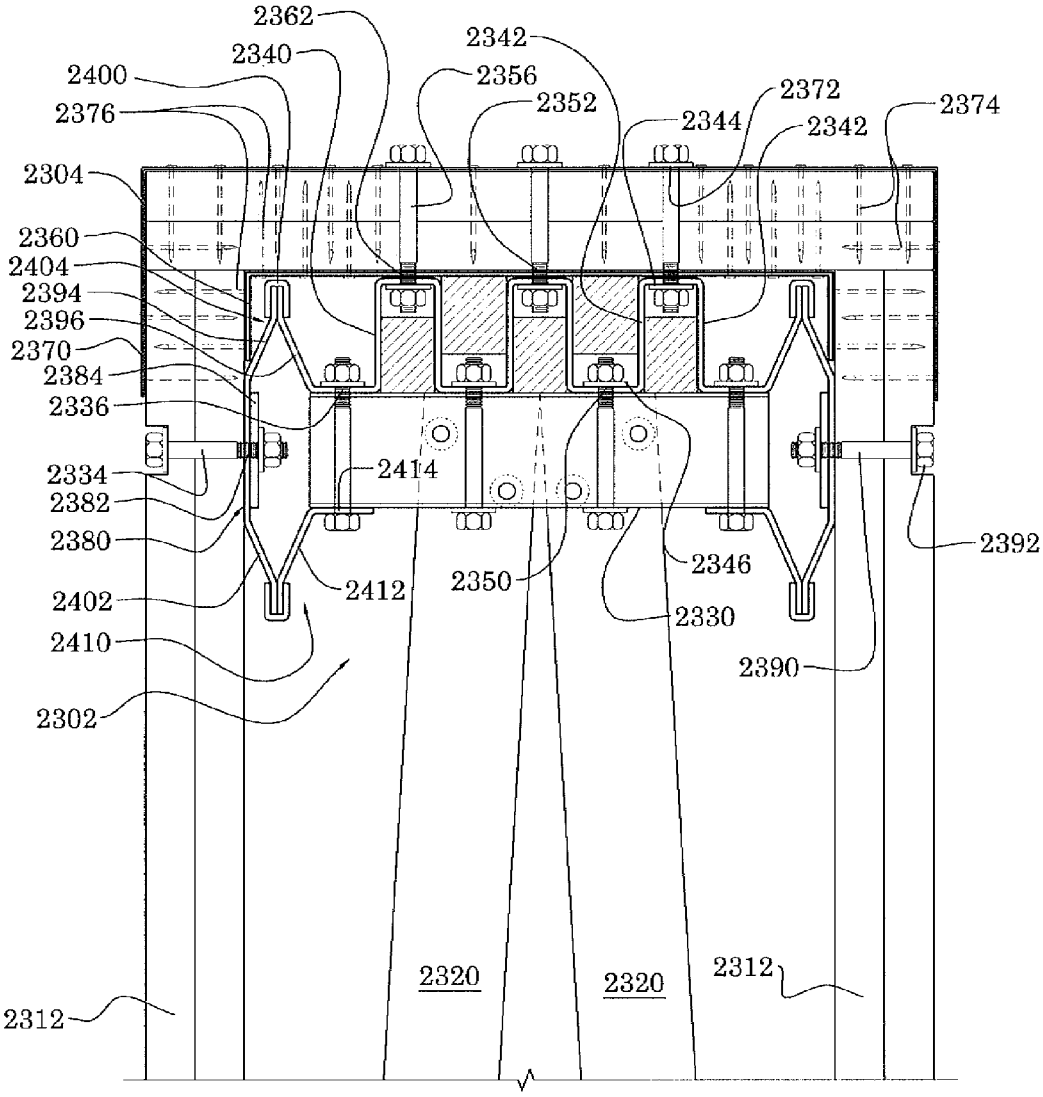
FIG. 5B shows one embodiment of the energy-dissipating member of the shear assembly of FIG. 5A.
Figure 5C:
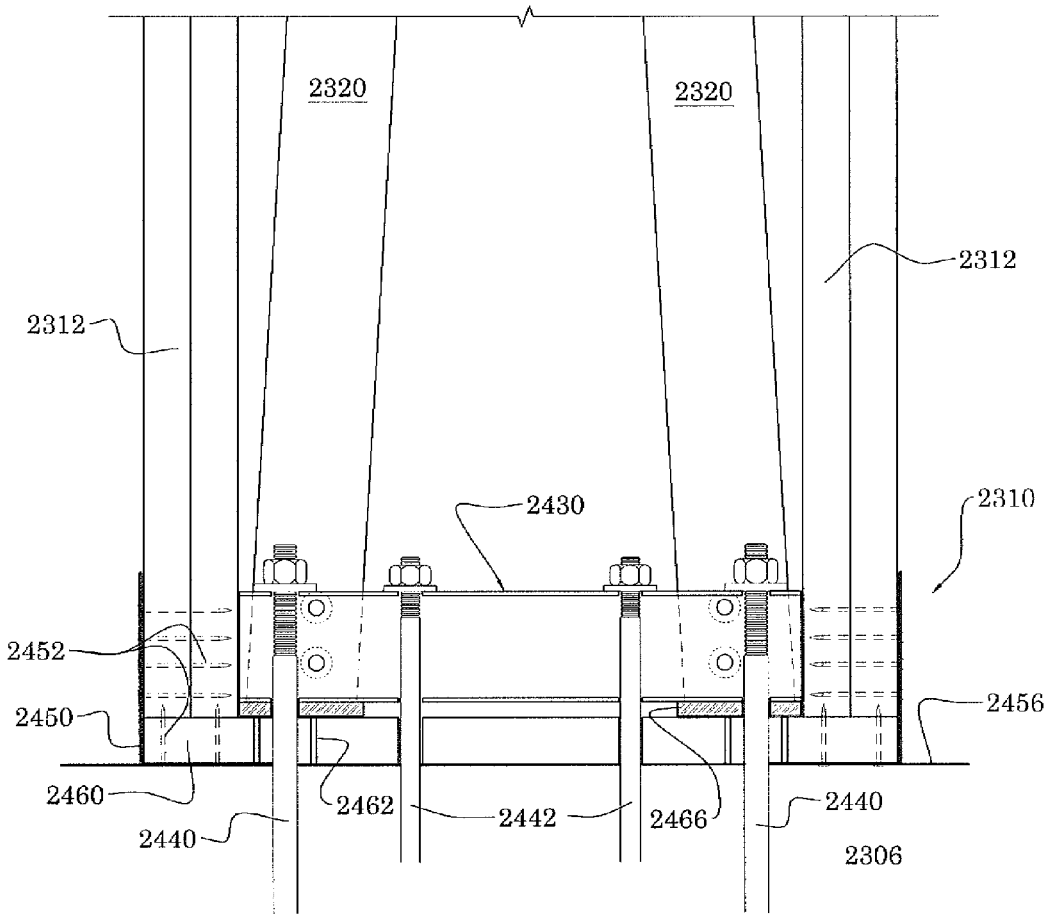
FIG. 5C shows one embodiment of the base of the shear assembly of FIG. 5A.

FIGS. 5A-C now show one embodiment of a shear assembly 2300 adapted for a wood stud frame structure. Similar to the shear assembly described above in reference to FIGS. 4A-I, the shear assembly 2300 includes an energy dissipating assembly 2302 that couples an interconnecting assembly 2308 to a top section 2304 of the frame structure. The interconnecting assembly 2308 is rigidly mounted to a foundation 2306 via a base mounting assembly 2310.

As shown in FIG. 5A, the energy dissipating assembly 2302, interconnecting assembly 2308, and the base mounting assembly 2310 are dimensioned to fit between two vertical sections 2312. In one embodiment, the shear assembly 2300 may be pre-fabricated as a unit that includes the vertical sections 2312 and the top section 2304. The shear assembly 2300 described in reference to FIGS. 5A-C is such a unit. It will be appreciated, however, that in other embodiments, the shear assembly 2300 having the energy dissipating assembly 2302, interconnecting assembly 2308, and the base mounting assembly 2310 can be installed between two existing adjacent studs of the frame structure without departing from the spirit of the present teachings.

In one embodiment, the shear assembly 2300 has an overall thickness (along the direction in and out of the page of FIG. 5A) that allows flush mounting of flat panels to the studs 2312. In one embodiment, the shear assembly 2300 further includes a brace 2314 that braces the mid portion of the interconnecting assembly 2308 and allows a limited lateral movement of the studs 2312 with respect to the interconnecting assembly 2308 in a manner similar to that described above in reference to FIG. 4A.

In one embodiment, the interconnecting assembly is in the form of an A-frame. It will be appreciated, however, that other structures can couple the foundation to the energy dissipating assembly in a secure manner without departing from the spirit of the present teachings. As shown in FIG. 5A, the example A-frame interconnecting assembly 2308 includes two legs 2320 arranged in an "A" configuration.

FIG. 5B shows a detailed view of the top portion of the shear assembly 2300. In one embodiment, a frame of the pre-fabricated shear assembly includes a top plate 2304 that joins the top ends of the vertical (stud) sections 2312. In one embodiment, the top plate 2304 is formed by two 2×4 nominal wood members having a length approximately equal to the distance between the outer sides of the two adjacent vertical (stud) sections 2312. Each of the vertical (stud) sections 2312 is formed by two 2×4 nominal wood members.

In one embodiment, an outer strap 2370 having an inverted "U" shape attaches the outer sides of the top of the vertical stud sections 2312 to the top and ends of the top plate 2304. Each of the three sections of the inverted-U shaped outer strap 2370 has a width that is similar to the thickness (3.5" in one embodiment that uses the 2×4 nominal wood members) of the top plate 2304 and the vertical sections 2312. Each of the three sections defines a plurality of fastening holes that allow passage of a plurality of fasteners 2374 that secure the outer strap 2370 to the top plate 2304 and the top ends of the vertical stud sections 2312. In the embodiment where two 2×4 nominal wood members are used for the top plate and the vertical stud sections, the fasteners 2374 are preferably long enough to extend into the lower/inner wood members, so that the fasteners 2374 also secure the two wood members. In one embodiment, the fasteners 2374 are nails, but it will be understood that any other fasteners can achieve similar results. In one embodiment, the outer strap may be thin enough that fastening holes may not need to be pre-formed. Nails or similar fasteners may be driven through the thin sections and into the top plate 2304 and the vertical sections 2312.

In one embodiment, an inner strap 2360 having an inverted "U" shape attaches the inner sides of the top of the vertical stud sections 2312 to the bottom of the top plate 2304. In one embodiment, the inner strap 2360 is secured in a manner similar to that of the outer strap 2370.

As shown in FIG. 5B, the coupling and energy dissipating function of one embodiment of the assembly 2302 is provided by a plurality of deformable plates 2342 joined at the top and bottom in an alternating manner so as to form a plurality of corrugations 2340. Adjacent plates 2342 are joined at the top by a top joining plate 2344 that defines a mounting hole 2352. The mounting holes allow attachment of the top joining plates 2344 to the top plate 2304 in a manner described below. A bottom joining plate 2346 joins adjacent plates 2342 at the bottom so that bottom joining plates 2346 and top joining plates 2344 alternate in the corrugation pattern. The bottom joining plates 2346 define mounting holes 2350 that allow attachment of the bottom joining plates 2346 to the legs 2320 in a manner described below.

In one embodiment, the plurality of corrugations 2340 are attached to the top plate 2304 in the following manner. The horizontal sections of the outer and inner straps 2370, 2360 define mounting holes 2372, 2362 that align with the mounting holes 2352 on the top joining plates 2344. The top plate 2304 defines a plurality of holes aligned with the mounting holes 2372 and 2362, so that a plurality of fasteners such as bolts 2356 can pass through the aligned holes 2372, 2362, and 2352 and secure the top joining plates 2344 to the top plate 2304.

In one embodiment, such as that shown in FIG. 5B, the plurality of corrugations 2340 are attached to the legs 2320 via a top cross member 2330 in a manner generally similar to that of the attachment described above in reference to FIGS. 4B and F.

In one embodiment, the energy dissipating assembly 2302 includes a side coupling 2410 that couples the top cross member 2330 to each of the vertical sections 2312.

In one embodiment shown in FIG. 5B, the side coupling 2410 includes an inner angled plate 2396 that extends upward at and outward from the outermost bottom joining plate 2346. The upper end portion of the inner angled plate 2396 is coupled to the upper end portion of an outer angled plate 2394 such that the inner and outer angled plates 2396 and 2394 form an inverted "V" shape.

Such an inverted V-shaped structure can be formed by bending of a single strip of metal. In one embodiment as shown in FIG. 5B, the upper end portions of the inner and outer angled plates 2396 and 2394 have additional vertically extending sections that are capped and secured by a cap 2400 so as to form an inverted "Y" shaped structure 2404.

As shown in FIG. 5B, the outer angled plate's (2394) lower end portion is joined with a downward extending vertical plate 2380. The vertical plate 2380 is positioned adjacent the inner side of the vertical section 2312, and defines a mounting hole 2382 that allows a fastener such as a bolt 2334 to secure the vertical plate 2380 to the inner side of the vertical section 2312. In one embodiment, a mounting plate 2384 (having a mounting hole) is interposed between the vertical plate 2380 and the fastening end (such as a nut) so that the fastening force of the nut is distributed.

In one embodiment, a lower Y-shaped structure 2402 similar to (but inverted with respect to) the upper Y-shaped structure 2404 is joined to the lower end of the vertical plate 2380. Thus, the upper and lower Y-shaped structures 2404 and 2402 form a deformable bellow-like structure that couples the legs 2320 (via the top cross member 2330) to the inner sides of the vertical sections 2312. When a shear force pushes the upper portion of the vertical section 2312 towards the legs 2320, the bellow structure can collapse and dissipate at least some of the energy associated with the force. When a shear force causes the upper portion of the vertical section to move away from the legs 2320, the bellow structure can stretch and dissipate at least some of the energy associated with the force.

In one embodiment, the caps 2400 (that couple the inner and outer angled plates 2396 and 2394) allow the corrugations 2340 and the side couplings 2410 on both sides to be formed as separate pieces and joined during assembly. In certain situations, such a feature may be desired over a single-piece coupling (such as that described above in reference to FIG. 4B).

In one embodiment, as shown in FIG. 5B, spaces defined by the deformable plates 2342 can be filled with various materials having different mechanical properties. As an example, energy absorbing materials such as rubber or "RUMBER" (a lumber-like structure formed from recycled rubber) can be dimensioned to fit in the spaces as shown. Such filler materials can be used to obtain a desirable response of the energy dissipating assembly 2302 (or the assembly 2062 of FIG. 4B, although not shown).

In one embodiment, the corrugations 2340 are formed from a metal strip having a thickness of approximately 10 gauge. The outer portions of the side couplings 2410 are formed from a metal strip having a thickness of approximately 10 gauge.

FIG. 5C now shows various details of the base mounting assembly 2310.

In one embodiment, the assembly 2310 secures the legs 2320 of the interconnecting structure to the foundation 2306 in a substantially rigid manner.

In one embodiment as shown in FIGS. 5A-C, the shear assembly 2300 is a prefabricated unit. Thus, the bottom ends of the vertical sections 2312 are attached to a bottom plate 2460 by an outer strap 2450 in a manner similar to that described above in reference to the outer strap 2370 of FIG. 5B. In one embodiment, the bottom plate 2460 is a 2×4 nominal wood member.

As further shown in FIG. 5C, the legs 2320 are secured at the bottom by a bottom cross member 2430 in a manner similar to that described above in reference to FIG. 4G. Similarly, the bottom cross member 2430 receives and secures to uplift-resisting anchor bolts 2440 and lateral-movement-resisting bolts 2442 in a manner similar to that described above in reference to FIG. 4G.

In one embodiment, a tubular sleeve 2462 is embedded in the bottom plate 2460 at a location that allows the uplift-resisting anchor bolts 2440 to pass vertically therethrough. Such a sleeve can inhibit crushing damages to the bottom plate 2460.

In one embodiment, compression plates 2466 are interposed between the tops of the sleeves 2462 and the bottom side of the cross member 2430. Such compression plates can distribute the downward forces applied by the legs 2320 on the sleeves 2466 and areas around them.

In one embodiment, various components of the shear assembly described above in reference to FIGS. 5A-C have the following dimensions and properties. The corrugations 2340 are formed from a single metal strip having a thickness of approximately 10 gauge.

Figure 6A:
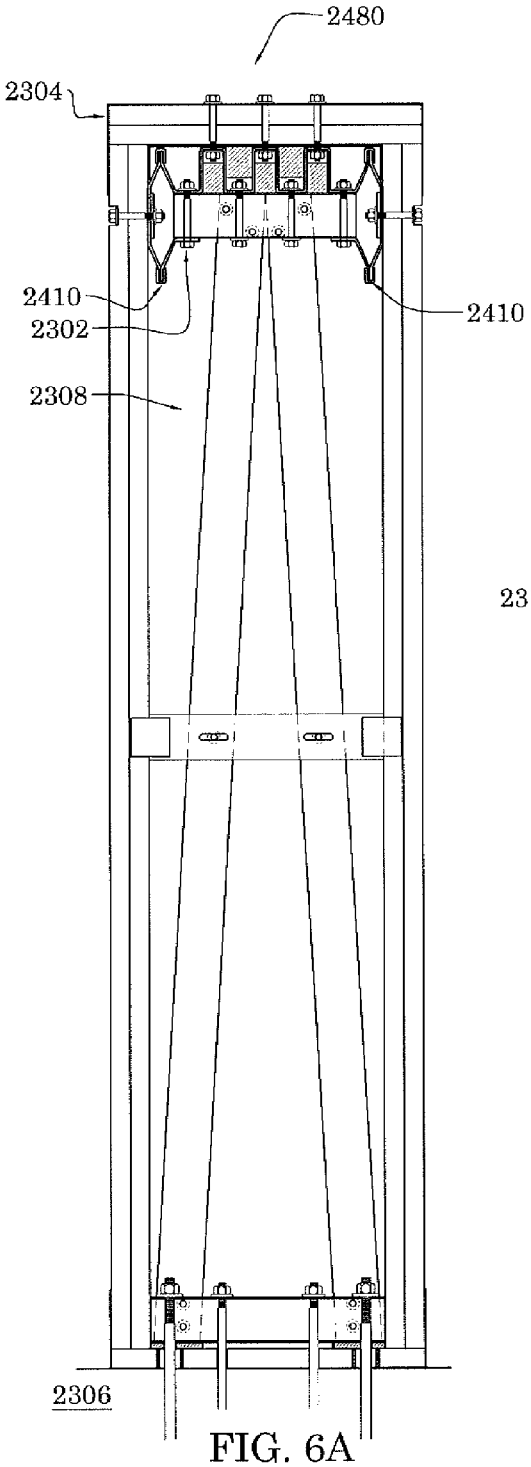
FIGS. 6A and B show deformation of the energy-dissipating member of the shear assembly of FIG. 5A when subjected to a shear force.
Figure 6B:
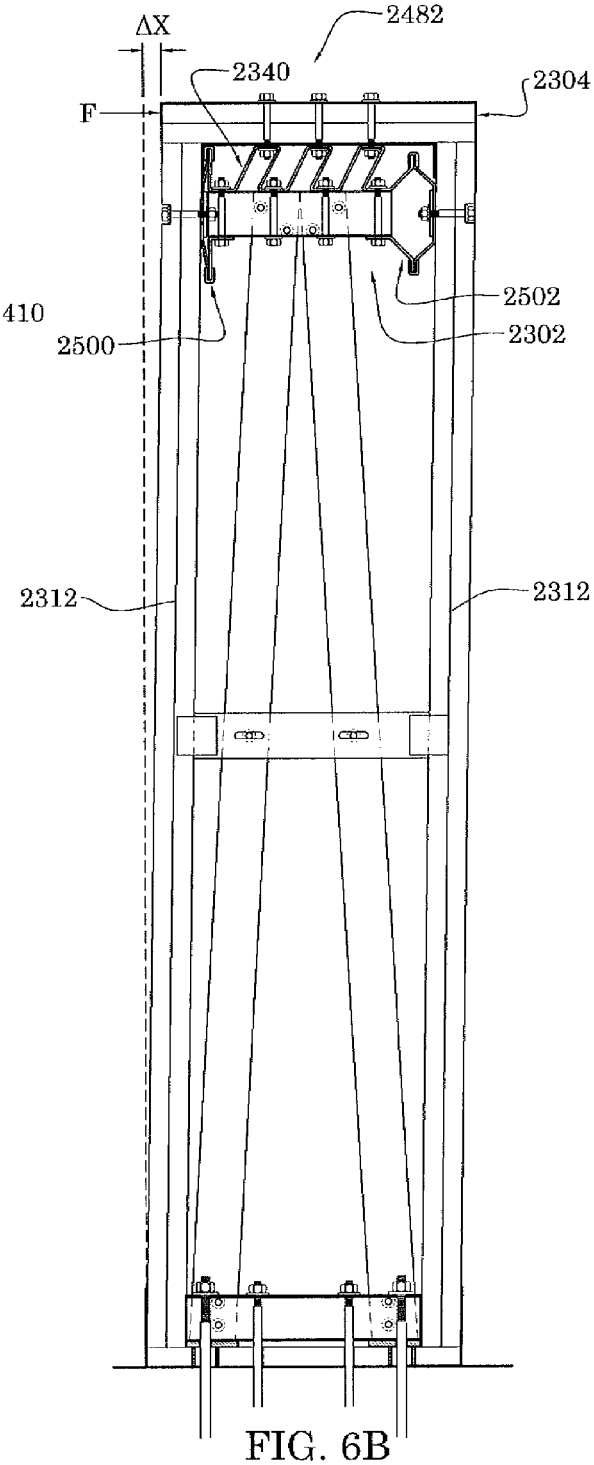

FIGS. 6A and B show at-rest 2480 and displaced 2482 configurations of the shear assembly 2300 described above in reference to FIGS. 5A-C. As shown in FIG. 6B, a shear force F acting on the top plate 2304 causes the top plate 2304 and the upper portion of the vertical sections 2312 to be displaced laterally by an amount $\Delta X$. When subjected to a displacing shear force F, the plurality of corrugations 2340 are depicted as being deformed. Furthermore, one (2500) of the side couplings 2410 collapses by deformation, and the other (2502) becomes stretched by deformation. The deformations of the corrugations and/or the side couplings can thus provide the energy dissipating function in response to the shear force.

As shown in FIG. 6B (and also in FIG. 3B), the deformation of the corrugations is depicted as bending of the corners above and below the deformable plates. It will be understood, however, that such deformation is just one of numerous possible modes of energy-dissipating deformation modes. For example, the deformable plate can act as a leaf spring for the initial phase of the displacement, and when the restorative limit is exceeded, the plate itself can bend in a deforming manner. As shown in FIG. 6B, the folded corners above and below the plate can also deform by folding and unfolding.

Figure 7:
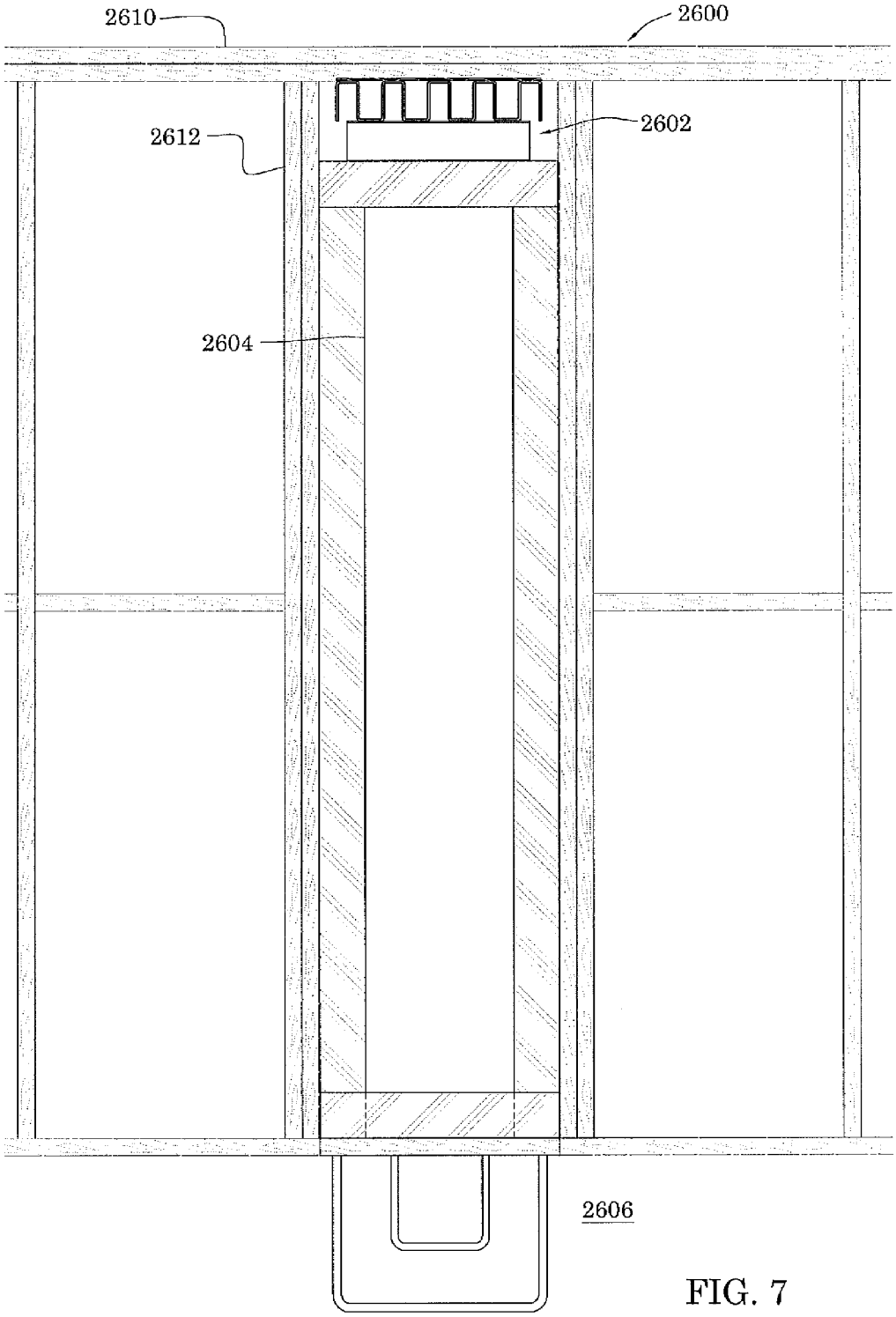
FIG. 7 shows one embodiment of the shear assembly having a panel-type interconnecting assembly.

FIG. 7 now shows an example of a shear assembly 2600 where an interconnecting assembly 2604 is not an A-frame type structure. In one embodiment, the interconnecting assembly 2604 is a panel. Such a panel can have a structure similar to those disclosed in the U.S. patent application Ser. No. 09/932,181, filed on Aug. 17, 2001, entitled "A-FRAME SHEAR ASSEMBLY FOR WALLS." Also, the panel 2604 can be secured to the foundation 2606 in a similar manner.

In one embodiment, the panel 2604 is coupled to a top plate 2610 by a deformable energy dissipating assembly 2602 depicted as a plurality of corrugation. As seen from the description herein, the assembly 2602 can be configured and mounted to the panel 2604 and top plate 2610 in a variety of ways to provide the energy dissipating function. The assembly 2602 can also be configured to couple to the upper portion of vertical sections 2612.

Figure 8:
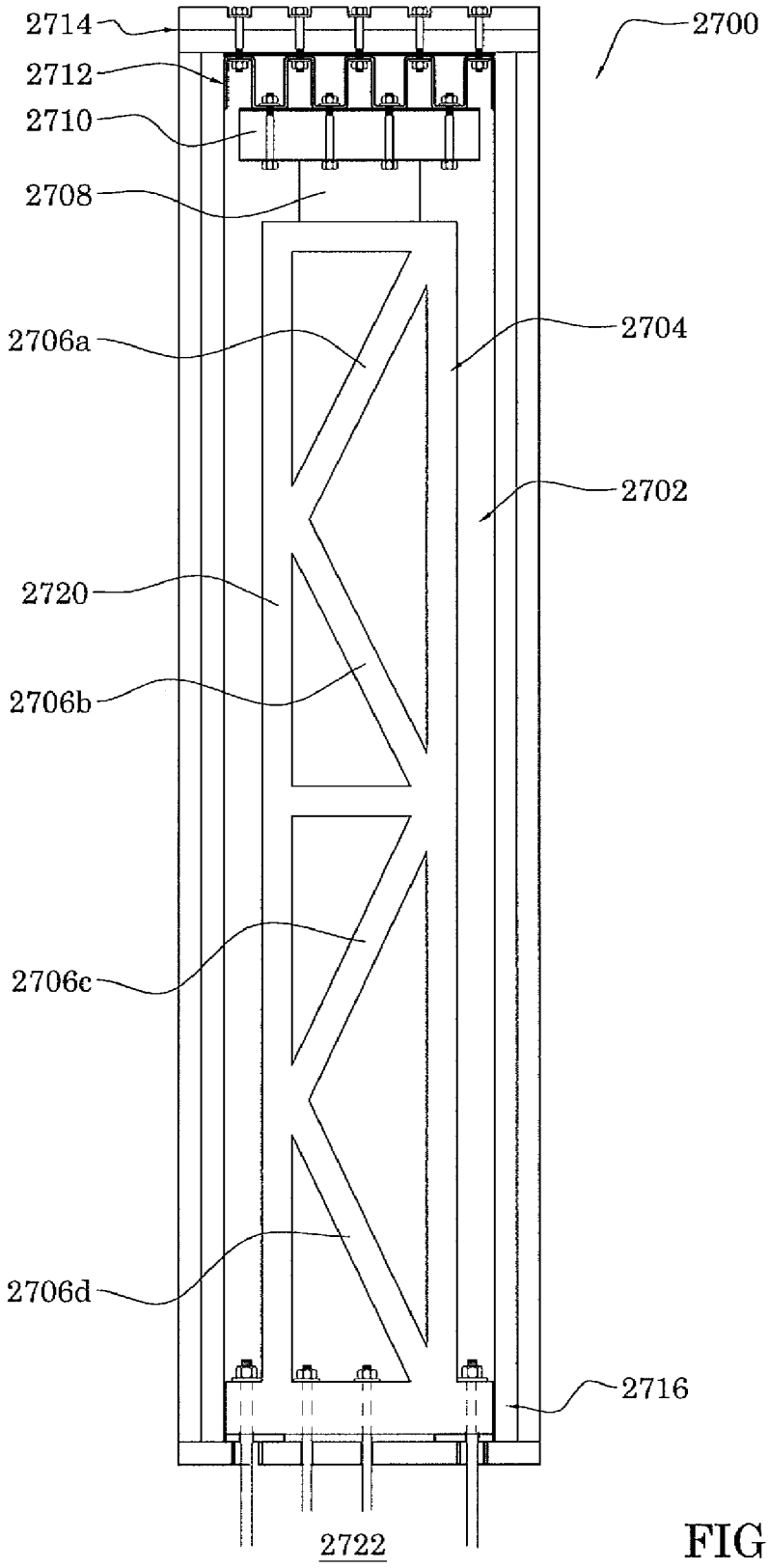
FIG. 8 shows one embodiment of the shear assembly having a braced frame.

FIG. 8 now shows an example of another embodiment of a shear assembly 2700 where the interconnecting assembly includes a braced frame 2702. In one embodiment, the braced frame 2702 includes a rectangular frame 2704 braced by a plurality of alternating diagonal brace members 2706. As shown in FIG. 8, two adjacent diagonal brace members 2706 and a vertical section 2720 of the rectangular frame 2704 generally form a "K" shape. As an example, the diagonal brace members 2706*a* and 2706*b* join at the vertical section 2720 to form the "K" shape. Another (reverse) "K" shape is formed by the diagonal brace members 2706*b* and 2706*c*.

The number of diagonal brace members 2706 (and thus the number of "K"s) can vary depending on the design of the "K" brace frame. In one embodiment, the rectangular frame 2704 and the diagonal brace members 2706 are hollow metal tubes (e.g., hollow rectangular tubes), and the K-frame is formed by welding of such tubes.

In one embodiment, the K-brace frame 2702 is substantially rigidly attached to a cross member 2710 via a connecting piece 2708. A deformable coupling assembly 2712 can be mounted to the cross member 2710 and also to a top section 2714 in a manner described herein so as to deformably couple the top section 2714 to the K-brace frame 2702. In one embodiment, the K-brace frame 2702 is substantially rigidly attached to the foundation 2722 via a base mounting assembly 2716. Thus, the K-brace frame 2702 provides a substantially rigid coupling between the deformable coupling assembly 2712 and the foundation 2722.

From the foregoing description of the various embodiments of the deformable couplings, one can see that the energy dissipation can be achieved by some combination of shear, bending, and/or tension of the deformable component(s) of the coupling. Such modes of deformation counter the shear force that is applied nearby, so that the deformation of the coupling occurs substantially before, if any, the shear force is transmitted to the lower portion of the frame wall.

As seen in the description herein, the deformation of the various components of the coupling is facilitated providing attachment points relatively close to the deformable components. For example in the corrugation embodiment, the alternating top and bottom joining segments are attached respectively to the top section and the interconnecting assembly. While it is not a requirement to have every such joining segments attached, such attachments provide a more direct transfer of the shear force to the deformable component.

In the corrugation embodiments of the deformable coupling, the deformable "plates" extend in a direction having a component that is perpendicular to the lateral shear force. As previously described, materials and dimensions of such deformable plates can be selected to meet the desired design requirements for different building applications.

It will be appreciated that various embodiments of the deformable components of the coupling are described herein as deforming in one "direction" in response to the applied shear force. In some shear force situations, such as an earthquake, the shear force is not necessarily in one direction. Some combination of the earthquake-related force and the mechanical property of the building structure may cause the shear force to somewhat oscillate. In such situations, the deformable coupling of the present teachings can provide a desired response. A device that deforms in the foregoing manner generally does not produce a pinched hysteresis response to reversed cyclical forces, but instead produces substantially hysteretic behavior resulting in larger reductions in earthquake effects, including forces and energy, as can be imposed on light frame structures by a seismic event. That is, the reverse shear force (to the original shear force in a first direction) causes the deformed coupling to deform the other way. Such "second" deformation may not restore the general configuration of the coupling, the second deformation itself dissipates the energy associated with the reverse shear force. Such reversed cyclical forces can be reduced each time the shear force reverses direction. Again, each of these reversed cyclical shear forces are countered by the deforming coupling before being transferred to the lower portion of the frame wall.

As described herein, at least some of the various embodiments of the deformable couplings reduce damage to the wall frame by acting as a deformable sacrificial couplings. That is, once the coupling has performed its intended function, it becomes deformed so that subsequent use may not be desired.

The manner in which various embodiments of the deformable couplings are mounted allows the sacrificial couplings to be initially installed and subsequently replaced (if necessary) relatively easily. As an example, one embodiment of the coupling is shown in FIG. 4B and described above, where the plurality of mounting fasteners can facilitate an example replacement as follows, assuming that the top portion of the shear assembly becomes accessible (e.g., by have a portion of the panel removed). Nuts associated with the bolts 2134 can be removed from the bottom thereby freeing the coupling from the top portion of the frame, and the bolts can remain extending downward from within the inverted-hat channel 2120. Nuts associated with bolts 2098 can be removed from the top of the cross member 2090, and the bolts 2098 can be urged out downward, thereby freeing the coupling from the interconnecting assembly. The sides of the coupling can be freed from the vertical sections by removing the bolts 2158. Once the coupling is freed from the top, bottom, and side engagements, it can be removed in a relatively easy manner. Because the coupling that is not attached to anything can be restorably deformed to some degree, installation of a new unit into the mounting position (e.g., into the C-channel) can be achieved in a relatively easy manner. The installation can be achieved in a generally reverse manner as the removal. Also, the coupling embodiment shown in FIG. 5B and described above can be removed and installed in a similar relatively easy manner.

From the description herein, one can see that the various deformable couplings are not only relatively easy to replace, but are relatively easy to manufacture. Because the deformable couplings can be formed from common ductile strips of metal, they can be stamped out and formed by bending. Various mounting holes can also be punched out from the strips in a relatively easy manner.

Although the above-disclosed embodiments have shown, described, and pointed out the fundamental novel features of the invention as applied to the above-disclosed embodiments, it should be understood that various omissions, substitutions, and changes in the form of the detail of the devices, systems, and/or methods shown may be made by those skilled in the art without departing from the scope of the invention. Consequently, the scope of the invention should not be limited to the foregoing description, but should be defined by the appended claims.

What is claimed is:

1. A system for reducing the effects of shear forces on a building structure, comprising:

a wall comprising a plurality of vertical studs wherein the wall includes an upper portion and a lower portion and wherein the upper portion of the wall is adjacent the upper portion of the building and the lower portion of the wall is adjacent a foundation of the building; and a shear assembly that fits within a space defined by two adjacent studs positioned laterally along the wall, the upper portion of the wall, and the lower portion of the wall, such that the shear assembly couples the upper portion of the wall to the foundation wherein the shear assembly comprises:

a deformable coupling assembly having an upper end and a lower end such that a relative lateral displacement of the upper and lower ends causes a restorable deformation followed by a non-restorable deformation of the deformable coupling assembly, wherein the upper end attaches to the upper portion of the wall in a substantially rigid manner; wherein the deformable coupling assembly being positioned near the upper portion of the wall and an interconnecting assembly being attached to the foundation in a substantially rigid manner provides a relatively short moment arm for the shear force applied to the upper portion of the wall so that the shear force is countered by the deformable coupling assembly before being transmitted to the foundation; wherein the deformable coupling assembly comprises a plurality of plates extending in a direction having a vertical component joined to the upper portion of the wall at a plurality of locations and to the interconnecting assembly at a plurality of locations such that the shear force applied to the upper portion of the wall is transmitted to the plurality of plates in a substantially direct manner; and wherein the plurality of plates are formed by a corrugated member having alternating upper and lower joining plates that join a plurality of vertical plates wherein the upper joining plates and lower joining plates respectively define plurality of joining locations at the upper and lower ends of the deformable coupling assembly;

the interconnecting assembly that interconnects the lower end of the deformable coupling assembly to the foundation in a substantially rigid manner such that the deformable coupling assembly couples the upper portion of the wall to the foundation so as to allow energy dissipation by restorable and non-restorable deformation of the deformable coupling assembly in response to a lateral shear force applied to the upper portion of the wall.

2. The system of claim 1, wherein the vertical plates act as leaf springs when the lateral displacement is restorable.

3. The system of claim 2, wherein the non-restorable deformation of the deformable coupling assembly includes non-restorable bending of the vertical plates.

4. The system of claim 2, wherein the non-restorable deformation of the deformable coupling assembly includes non-restorable folding or unfolding of corners defined by the vertical plates and the upper and lower joining plates.

5. The system of claim 1, further comprising a side coupling that deformably couples one of the studs to at least one of the upper or lower ends of the deformable coupling assembly thereby providing additional energy dissipation during a displacement of the upper portion of the stud relative to the foundation.

6. The system of claim 1, wherein the corrugated deformable coupling assembly is configured so as to allow relatively easy installation and replacement.

7. The system of claim 1, wherein the corrugated deformable coupling assembly is formed from a strip of ductile metal so as to facilitate relatively easy fabrication.

8. The system of claim 1, wherein the corrugated deformable coupling assembly dissipates energy by a combination of shear, bending, and tension of the plates.

9. The system of claim 1, further comprising a filler material interposed between the vertical plates so as to adjust the effects of the shear force on the deformable coupling assembly.

10. The system of claim 9, wherein the filler material comprises rubber.

11. The system of claim 1, wherein the wall comprises a light metal frame.

12. The system of claim 1, wherein the wall comprises a wood frame.

13. The system of claim 1, wherein the deformable coupling assembly being able to deform in restorable and non-restorable deformation manners allows for greater flexibility in the design of energy dissipating characteristics of the coupling between the upper portion of the wall and the foundation.

14. The system of claim 1, wherein the interconnecting assembly comprises an A-frame structure.

15. The system of claim 1, wherein the interconnecting assembly comprises a panel.

16. The system of claim 1, wherein the interconnecting assembly comprises a braced frame.

17. The system of claim 1, wherein the deformable coupling assembly in response to a reversed cyclic shear force deforms during each displacement of the top portion of the wall relative to the foundation, thereby increasing the energy dissipation of the reversed cyclic shear force.

18. The system of claim 17, wherein the deformation of the deformable coupling assembly has a substantially hysteretic behavior resulting in larger reductions in earthquake effects, including forces and energy, that are imposed on light frame structures by a seismic event.

* * * * *